US011543208B2

(12) United States Patent
Saunders et al.

(10) Patent No.: US 11,543,208 B2
(45) Date of Patent: Jan. 3, 2023

(54) FOLDING STOCK COUPLING SYSTEM FOR FIREARM

(71) Applicant: Sturm, Ruger & Comany, Inc., Southport, CT (US)

(72) Inventors: Frank J. Saunders, Weare, NH (US); Todd Wilkinson, Goshen, NH (US); Benjamin Gerard Hawkins, Sunapee, NH (US)

(73) Assignee: STURM, RUGER & COMPANY, INC.

( * ) Notice: Subject to any disclaimer, the term of this patent is extended or adjusted under 35 U.S.C. 154(b) by 64 days.

(21) Appl. No.: 17/192,173

(22) Filed: Mar. 4, 2021

(65) Prior Publication Data

US 2021/0348877 A1 Nov. 11, 2021

Related U.S. Application Data

(60) Provisional application No. 62/986,122, filed on Mar. 6, 2020.

(51) Int. Cl.
*F41C 23/04* (2006.01)
*F41C 23/14* (2006.01)

(52) U.S. Cl.
CPC ..... *F41C 23/04* (2013.01); *F41C 23/14* (2013.01)

(58) Field of Classification Search
CPC ..... F41C 23/14; F41C 23/04; F41A 11/04
USPC ..... 42/75.03, 73, 71.01
See application file for complete search history.

(56) References Cited

U.S. PATENT DOCUMENTS

| | | | | |
|---|---|---|---|---|
| 3,369,316 | A * | 2/1968 | Miller | F41C 23/04 42/72 |
| 4,513,523 | A | 4/1985 | Gal | |
| 5,209,215 | A | 5/1993 | Morrison | |
| 6,470,617 | B1 | 10/2002 | Gregory et al. | |
| 7,802,392 | B2 | 9/2010 | Peterson et al. | |

(Continued)

FOREIGN PATENT DOCUMENTS

| | | |
|---|---|---|
| CN | 208818074 U | 5/2019 |
| WO | WO2019/132806 A1 | 7/2019 |

OTHER PUBLICATIONS

International Search Report and Written Opinion issued in International Application No. PCT/US2021/020850 dated May 20, 2021.

*Primary Examiner* — Michael D David
(74) *Attorney, Agent, or Firm* — The Belles Group, P.C.

(57) ABSTRACT

A folding stock coupling system for a firearm. An openable/closeable hinge mechanism comprising front and rear hinge elements pivotably mounts the rear stock to the main body of the firearm. The hinge mechanism is selectively movable between a locked condition when the stock is unfolded and inline with the main body for firing, and an unlocked condition when the stock is folded forward and offset from the main body for compact carrying or storage. A manually movable actuating button of the hinge mechanism selectively locks or unlocks the rear to the front hinge members in the locked and unlocked conditions, respectively. Embodiments include a detent mechanism for removably retaining the folded position. An elongated rear mounting extension coupled to the rear hinge member provides a common stock mounting interface compatible for interchanging a plurality of different stocks to the firearm each sharing a common mounting profile.

28 Claims, 40 Drawing Sheets

(56) References Cited

U.S. PATENT DOCUMENTS

| | | | | |
|---|---|---|---|---|
| 7,827,721 | B2 | 11/2010 | Griffin | |
| D636,834 | S | 4/2011 | Mayberry et al. | |
| 7,941,958 | B1 | 5/2011 | Zedrosser | |
| 7,966,761 | B1 | 6/2011 | Kuczynko et al. | |
| 8,109,026 | B1 | 2/2012 | Bentley et al. | |
| 8,312,661 | B2 | 11/2012 | Ludlow | |
| 8,429,844 | B2 | 4/2013 | Dextraze et al. | |
| 8,464,458 | B2 | 6/2013 | Chvala | |
| 8,631,601 | B2 | 1/2014 | Langevin et al. | |
| 8,640,373 | B2 | 2/2014 | Burt | |
| 8,656,623 | B1 | 2/2014 | Chvala | |
| 8,769,855 | B2 | 7/2014 | Law | |
| 8,819,981 | B2 | 9/2014 | Malik et al. | |
| 8,915,005 | B2 | 12/2014 | Grimshaw et al. | |
| D745,627 | S | 12/2015 | Kielsmeier et al. | |
| 9,228,795 | B1 | 1/2016 | Kielsmeier et al. | |
| 9,347,738 | B1 | 5/2016 | Schumacher | |
| 9,464,863 | B2 | 10/2016 | Mather et al. | |
| 9,546,845 | B2 | 1/2017 | Mather | |
| 9,664,478 | B2 | 5/2017 | Robinson et al. | |
| 9,719,754 | B2 | 8/2017 | Law | |
| 9,829,272 | B2 | 11/2017 | Brown | |
| 10,088,265 | B2 | 10/2018 | Underwood et al. | |
| 10,113,830 | B2 | 10/2018 | Monveldt et al. | |
| 10,156,421 | B2 | 12/2018 | Smith et al. | |
| 10,260,837 | B1 * | 4/2019 | McGinty | F41A 3/84 |
| 10,704,848 | B1 * | 7/2020 | Zeider | F41A 3/66 |
| 11,313,643 | B2 * | 4/2022 | Yollu | F41C 23/04 |
| 2012/0144712 | A1 * | 6/2012 | Rostocil | F42B 14/064 42/59 |
| 2015/0176945 | A1 | 6/2015 | Simek | |
| 2016/0116250 | A1 * | 4/2016 | Mather | F41A 3/66 42/73 |
| 2017/0010065 | A1 | 1/2017 | Kielsmeier et al. | |
| 2018/0073835 | A1 * | 3/2018 | Saltzman | F41C 23/06 |
| 2019/0212095 | A1 * | 7/2019 | Ballard | F41A 11/04 |
| 2022/0074702 | A1 * | 3/2022 | Levi | F41C 23/14 |

* cited by examiner

FOLDING STOCK COUPLING SYSTEM FOR FIREARM

CROSS-REFERENCE TO RELATED APPLICATIONS

The present application claims the benefit of priority to U.S. Provisional Application No. 62/986,122 filed Mar. 6, 2020; the entirety of which is incorporated herein by reference.

BACKGROUND

The present invention generally relates to firearm stocks, and more particularly to an improved stock coupling system for mounting a folding stock to a long gun such as a rifle or shotgun.

The rear stock (or buttstock) in a long gun generally attaches to the rear portion of the forward main body of the firearm formed by the forend stock or chassis which supports the receiver. The rear stock is used for shouldering the firearm when sighting the target down range before and during firing. Various techniques may be used to interface and mount the rear stock to the chassis. Some rear stocks are fixed in position inline with the firearm, while others allow folding the rear stock to facilitate carrying and storage of the firearm. In addition, many users have personal preferences on the style and configuration of rear stocks or buttstocks that they favor.

An improved stock coupling system is desired which is compatible for use with various different aftermarket rear stock configurations to suit personal user preferences.

SUMMARY

The present disclosure provides an improved folding stock coupling system for detachably mounting the rear stock or buttstock to a forward main body of the firearm, which comprises the forend stock or chassis which in turn directly or indirectly supports the receiver of the firearm. The stock coupling system in one embodiment includes a universal rear stock mounting interface configured to accept a variety of different aftermarket rear stocks, and a detachable main body mounting interface. Such rear stocks for example may be AR-15 type rifle stocks in some embodiments, which are mounted to a standard buffer tube of these type firearms. The present stock coupling system advantageously allows the user to select both their rear stock and firearm of choice, and readily interchange stocks with different firearms. The stock coupling system employs minimal moving components thereby providing a mechanically simple and reliable foldable stock coupling system.

The stock coupling system in one embodiment includes a button-actuated locking hinge mechanism or assembly configured and operable to allow the stock to be changed between an open unfolded inline position relative to the main body and longitudinal axis of the firearm for firing, and a closed folded offset position for storage/carrying. The hinge mechanism is configured to selectively lock the stock in the unfolded position as well as automatically retain the stock in the folded position along side the firearm main body via a detent mechanism, as further described herein. The detent mechanism allows the rear stock to be rapidly unfolded and returned to the inline position for firing without manually unlatching any components separately. The hinge mechanism automatically re-locks into the inline position without manually actuating the actuating button.

The hinge mechanism may be detachably coupled to the main body of the firearm by a clamping mechanism in certain embodiments. In one configuration, the clamping mechanism may be configured for mounting to a section/segment of a wedge-shaped Picatinny rail located at the rear of the main body. The Picatinny rail, well known in the art without further elaboration, is one stock mounting interface provision encountered in some firearms. Other mounting interface configurations and systems however may be used including simply threaded fasteners.

The present stock coupling system is usable with any type of long gun such as without limitation a rifle or shotgun, or any other type of long-format military/law enforcement or civilian small arms weapon which utilizes a rear stock and could benefit from a folding stock design according to the present disclosure.

In one aspect, a stock coupling system for a firearm comprises: a longitudinal axis; a hinge mechanism comprising a front hinge member configured to be fixedly coupled to a main body of the firearm, and a rear hinge member pivotably coupled to front hinge member; the hinge mechanism selectively movable between a locked condition in which the rear hinge member is not movable relative to the front hinge member, and an unlocked condition in which the rear hinge member is movable relative to the front hinge member; an actuating button movably mounted to the hinge mechanism, the actuating button being configured to lock the rear hinge member to the front hinge member in the locked condition of the hinge mechanism; and an elongated rear mounting extension coupled to the rear hinge member, the rear mounting extension configured to detachably couple a rear stock thereto. In one embodiment, the actuating button is slideably mounted to the rear hinge member and manually depressible.

According to another aspect, a firearm with interchangeable stock coupling system comprises: a main body comprising a longitudinal axis; a hinge mechanism comprising a front hinge member fixedly coupled to the main body, and a rear hinge member pivotably coupled to front hinge member; the hinge mechanism selectively movable between a locked condition in which the rear hinge member is not movable relative to the front hinge member, and an unlocked condition in which the rear hinge member is movable relative to the front hinge member; an elongated rear mounting extension projecting rearward from the rear hinge member; a first stock slideably coupled to the rear mounting extension, the stock slideable between a plurality of axial positions on the rear mounting extension for adjusting a length of pull of the firearm; and an actuating button movably mounted to the hinge mechanism, the actuating button being configured to lock the rear hinge member to the front hinge member in the locked condition of the hinge mechanism; wherein the first stock is movable between an unfolded position in which the first stock is inline with the longitudinal axis when the hinge mechanism is in the locked condition, and a folded position in which the first stock is laterally offset from the longitudinal axis when the hinge mechanism is in the unlocked condition.

According to another aspect, a method for operating a stock coupling system of a firearm comprises: providing a firearm having a rear stock locked in an unfolded position inline with a longitudinal axis of the firearm; depressing an actuating button of a hinge mechanism having front and rear hinge members removably locked together; disengaging a pair of first locking protrusions on the actuating button from a pair of corresponding second locking protrusions on the front hinge member to unlock the hinge mechanism; rotating the rear stock about a pivot axis defined by the hinge mechanism; and placing the rear stock in a folded position laterally offset from the longitudinal axis of the firearm.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which.

Figure 1:
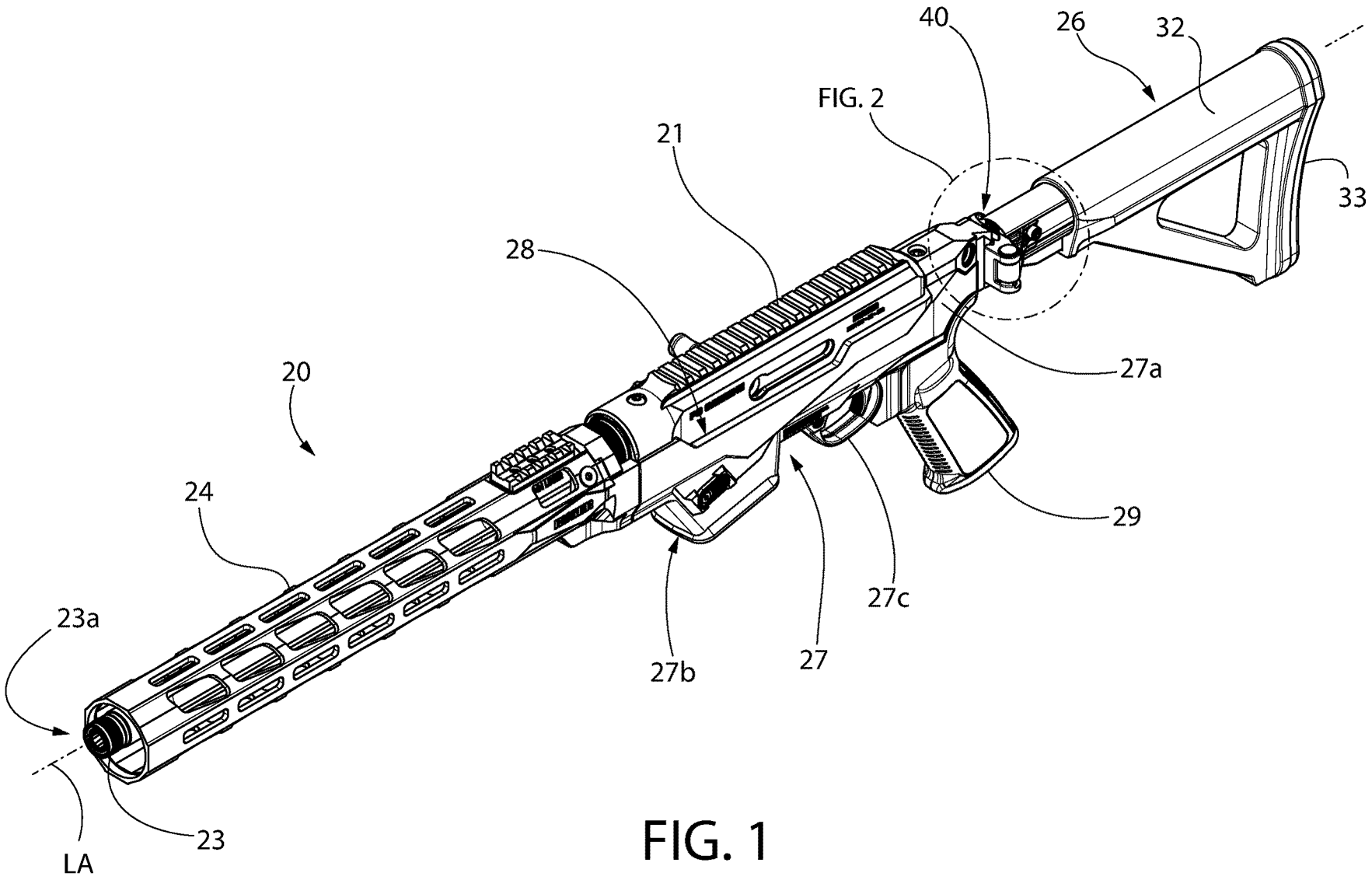
FIG. 1 is a top perspective view of one embodiment of a firearm with a folding stock coupling system according to the present disclosure.
Figure 2:
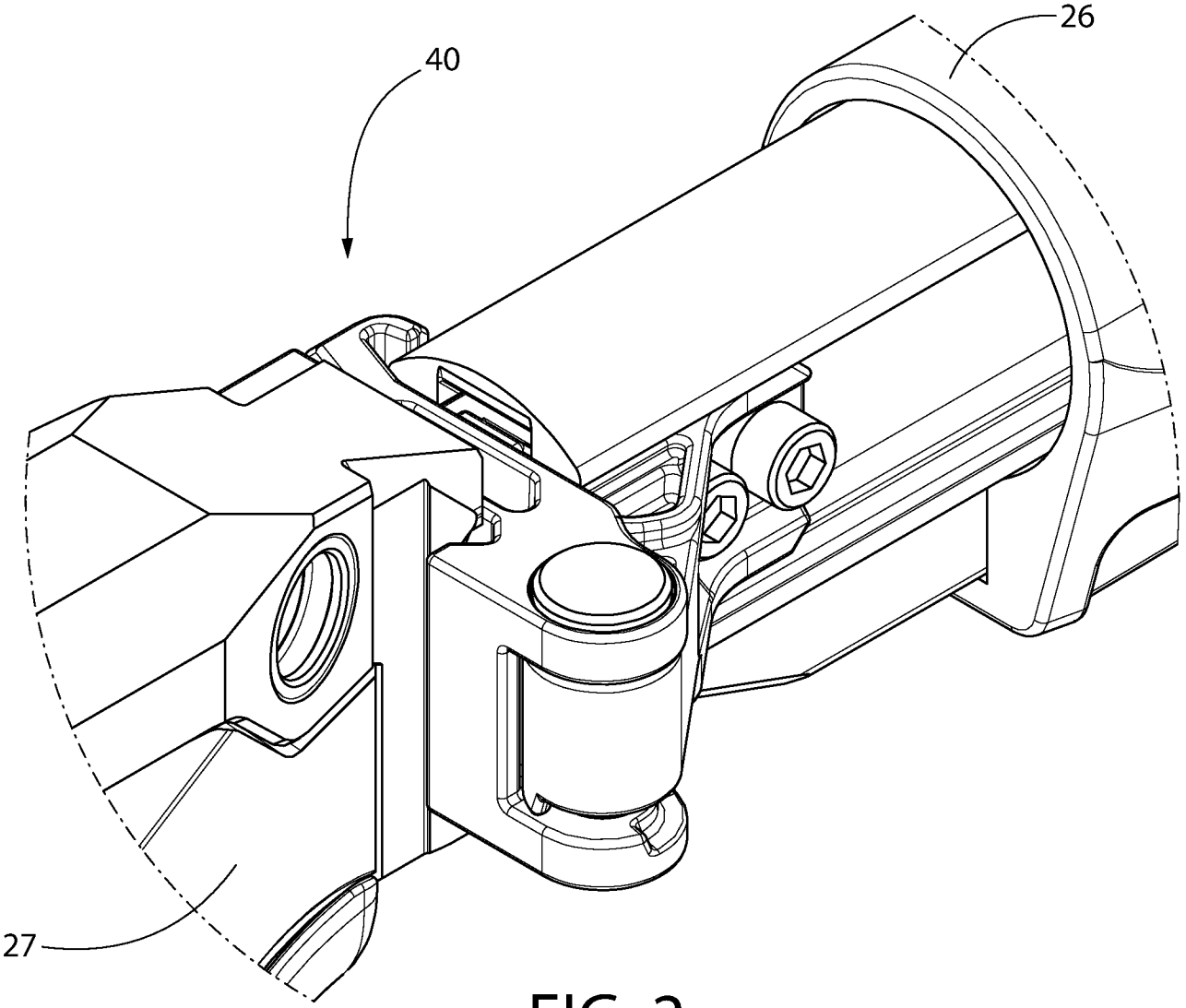
FIG. 2 is an enlarged detail therefrom.
Figure 3:
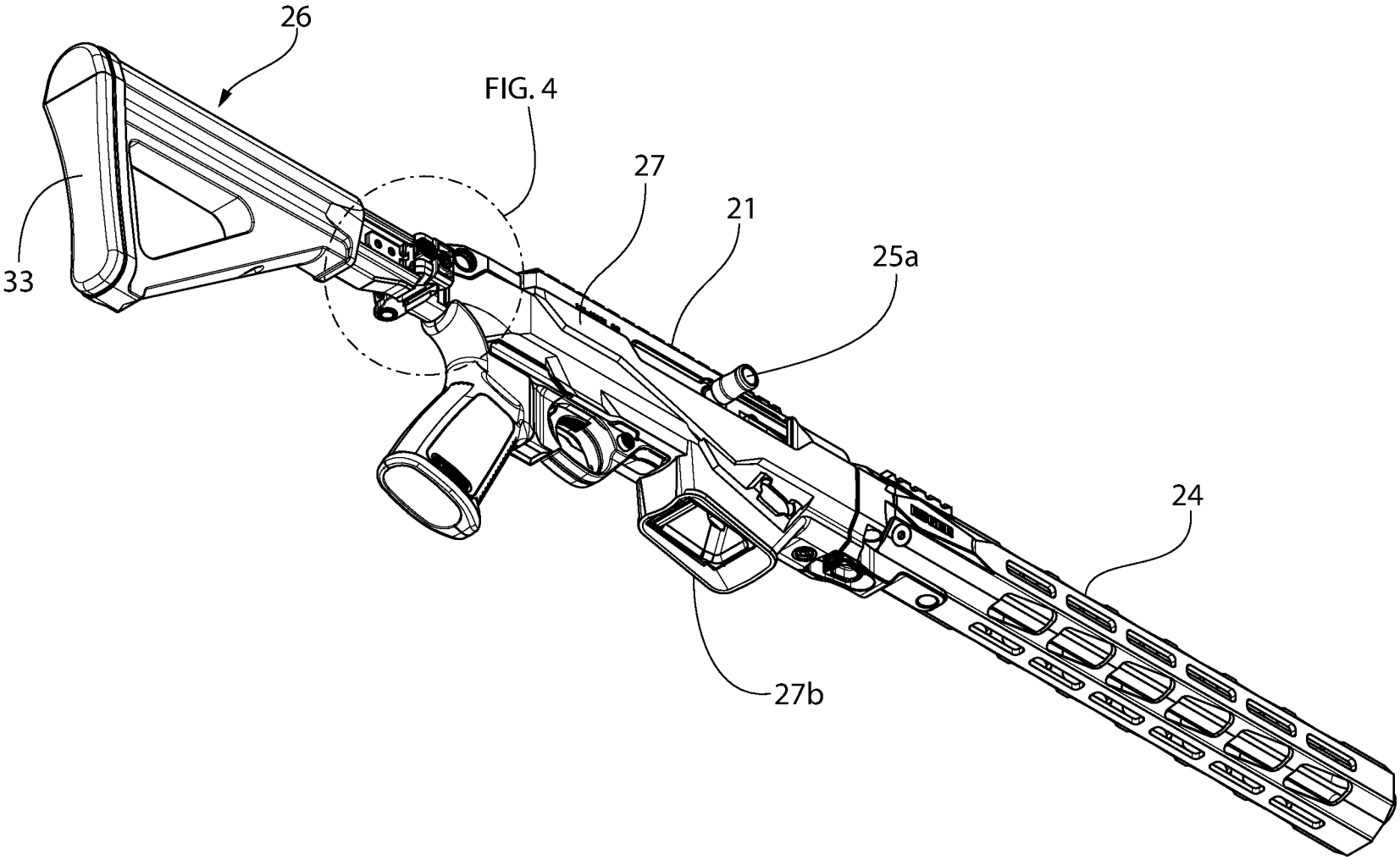
FIG. 3 is a bottom perspective view of the firearm of FIG. 1.
Figure 4:
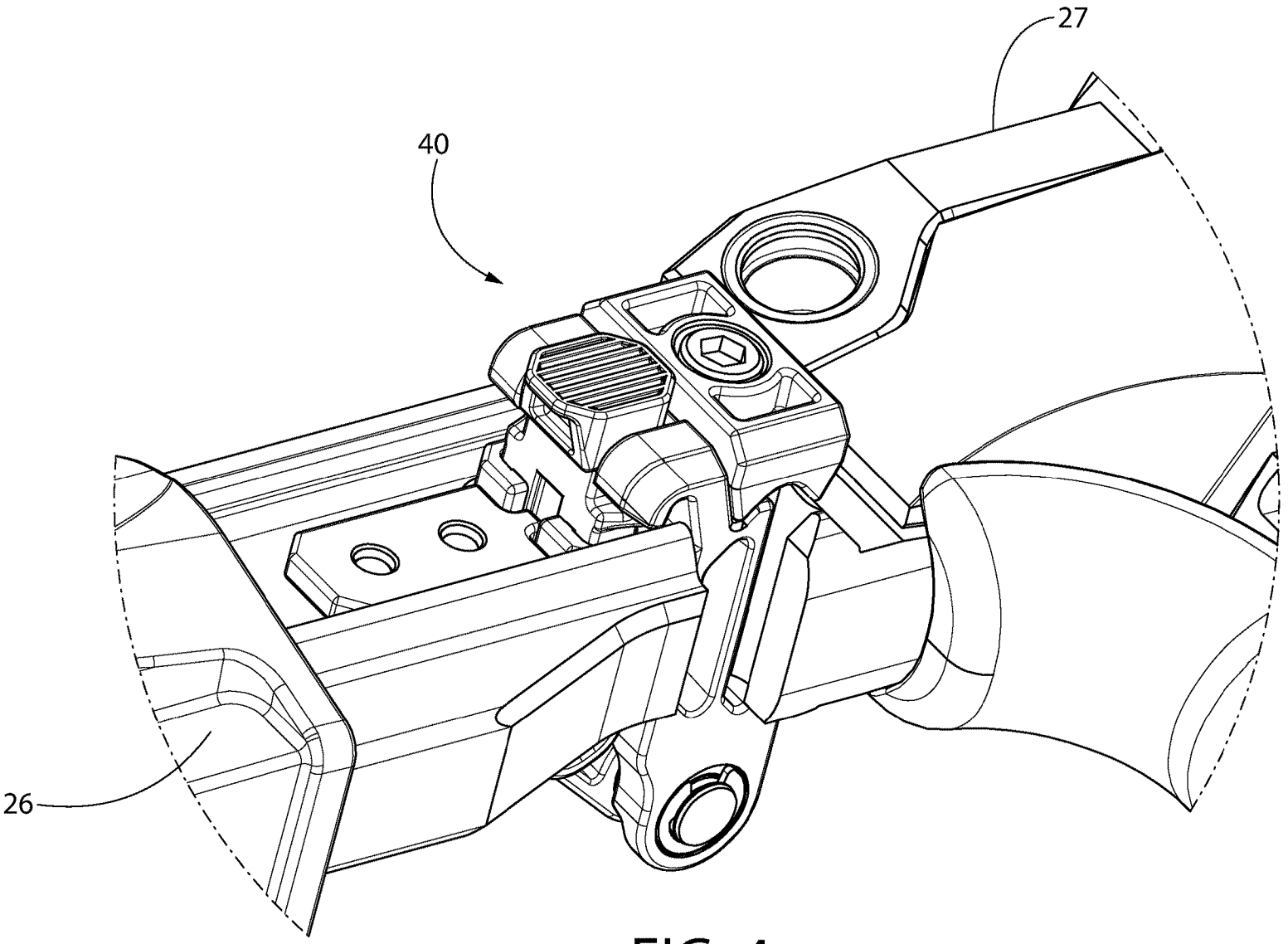
FIG. 4 is an enlarged detail therefrom.
Figure 6:
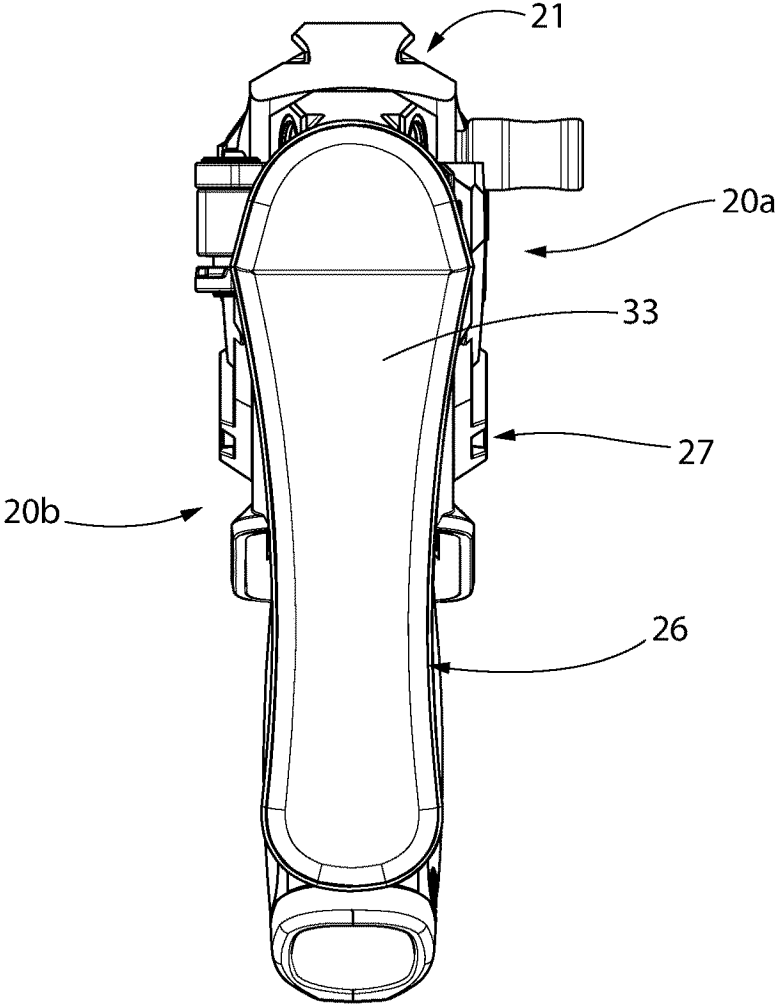
FIG. 6 is a rear view thereof.
Figure 5:
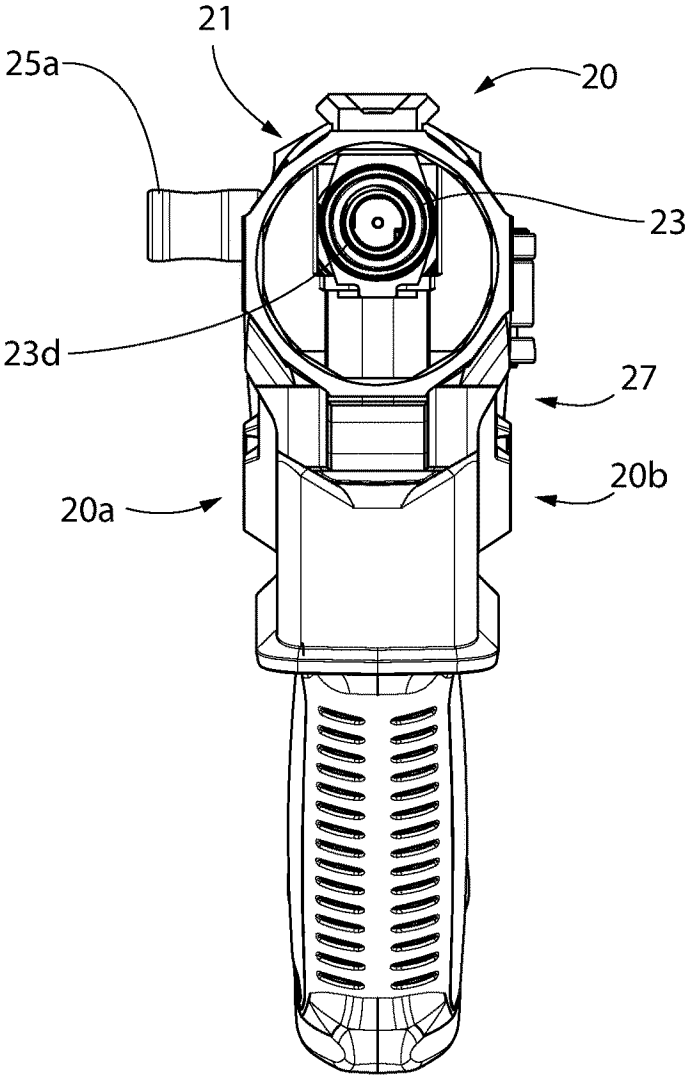
FIG. 5 is a front view of the firearm of FIG. 1.
Figure 7:
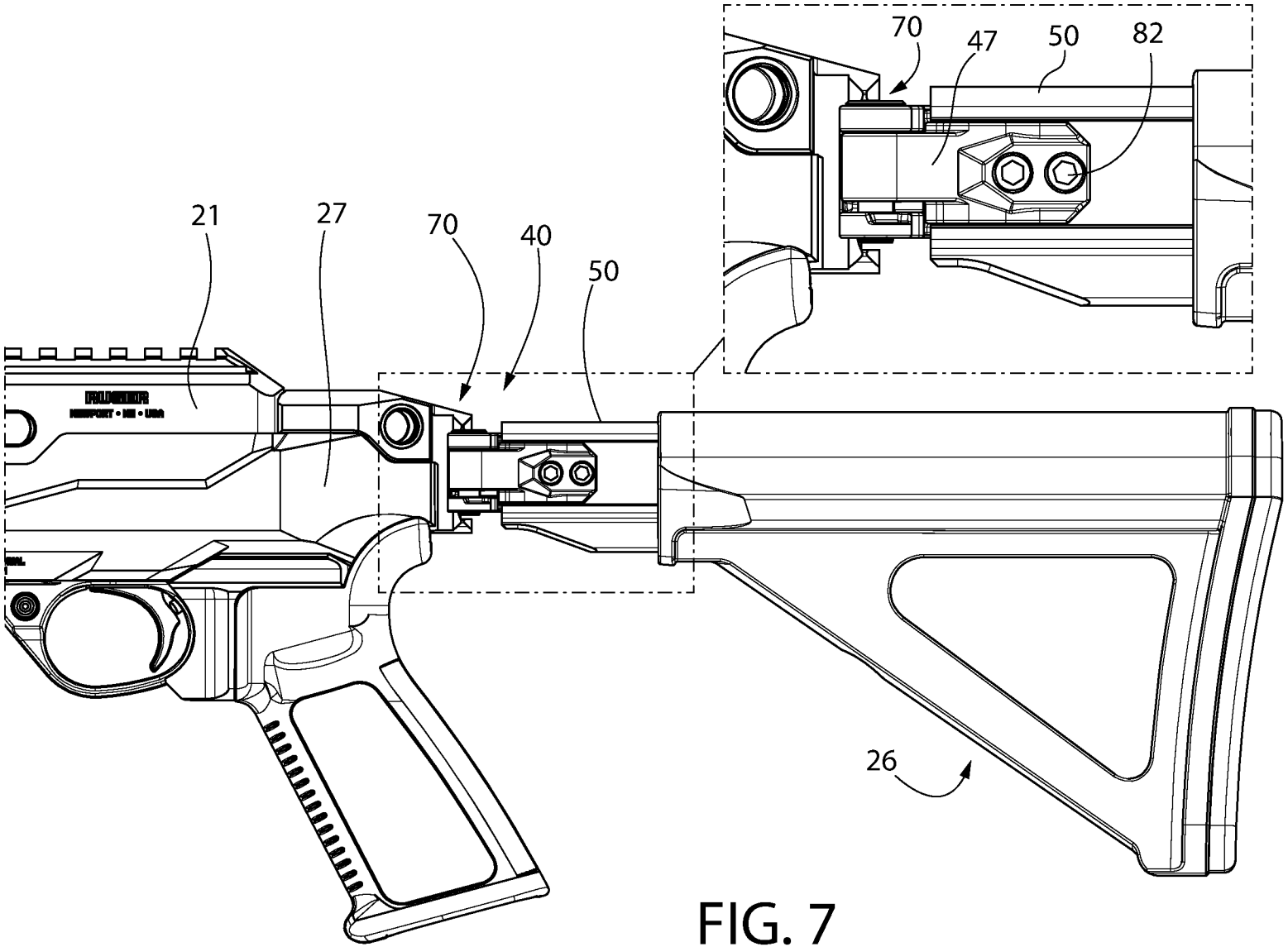
FIG. 7 is a partial rear left side view thereof.
Figure 8:
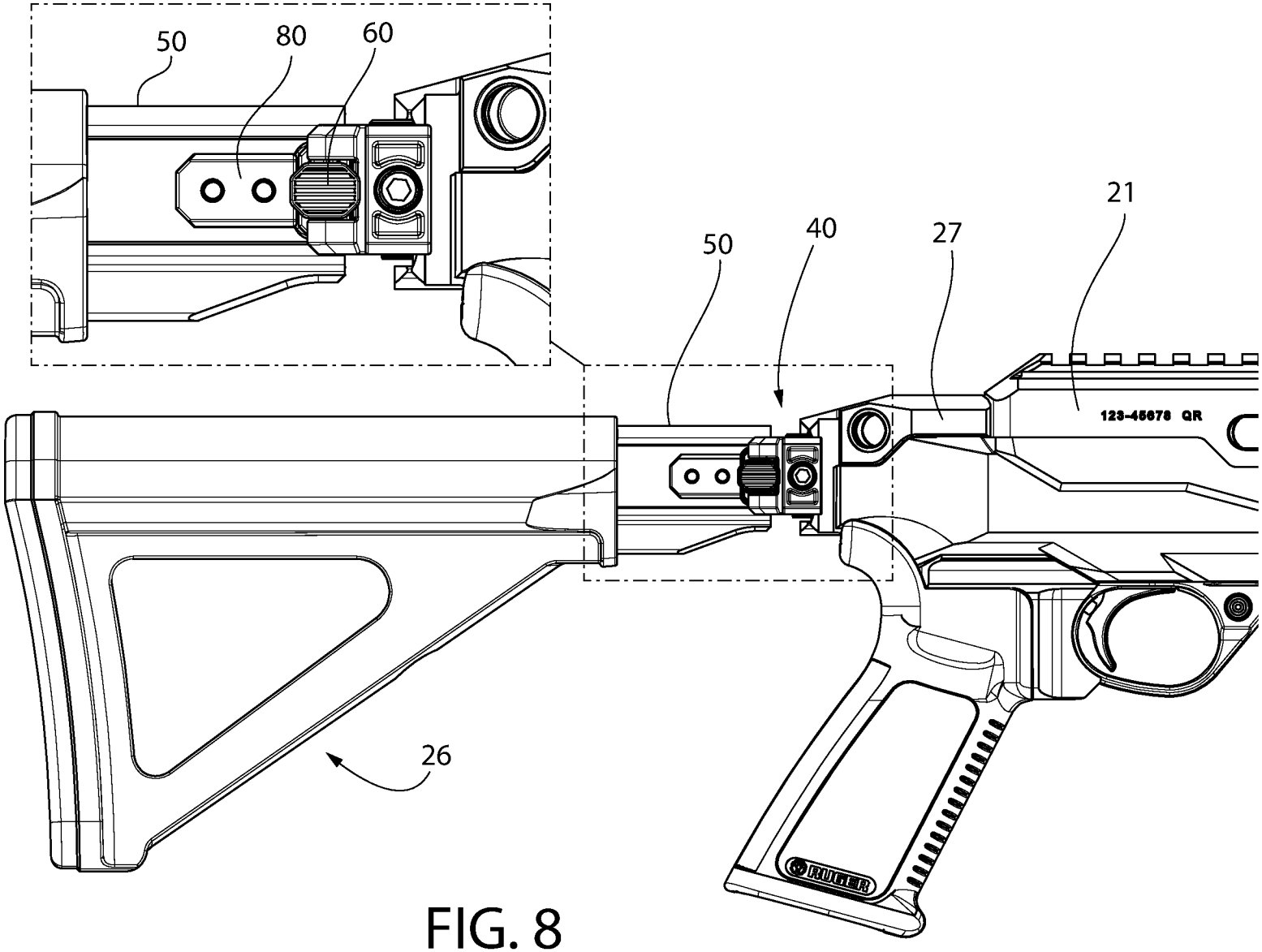
FIG. 8 is a partial rear right side view thereof.

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures in which they may be numbered or unnumbered unless otherwise noted herein. Furthermore, a general reference to a whole figure number which may include multiple alphabetic subparts shall be construed as a reference to all of the subparts unless specifically noted otherwise.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" which may be mentioned is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

As used throughout, any ranges disclosed herein are used as shorthand for describing each and every value that is within the range. Any value within the range can be selected as the terminus of the range. In addition, any references cited herein are hereby incorporated by reference in their entireties. In the event of a conflict in a definition in the present disclosure and that of a cited reference, the present disclosure controls.

Referring initially to FIGS. 1-15, a firearm 20 in the form of a rifle in one embodiment is shown including a folding stock coupling system according to the present disclosure. Firearm 20 may be any type of long gun or small arms weapon (e.g. grenade launchers, etc.) including without limitation a rifle or a shotgun. In the non-limiting example illustrated, the firearm 20 may be an auto-loading rifle. The stock coupling system is not limited in its applicability to any particular long gun or weapon however.

Firearm 20 generally includes a main body 27 which in the non-limiting illustrated embodiment comprises a forend stock or chassis 27*a*, receiver 21, a trigger actuated fire control mechanism 22 mounted in the chassis and operable to discharge the firearm, a barrel 23 supported by the receiver, optionally a handguard 24 enclosing and circumscribing at least part of the length of the barrel, and folding stock 26. Handguard 24 may similarly be coupled to a front end of the receiver and/or other portions of the firearm. The main body 27 of firearm 20 supports the receiver and fire control mechanism in one embodiment. Firearm 20 defines a right lateral side 20*a* and left lateral side 20*b* when viewed from the perspective of a user normally aiming the firearm downfield.

Barrel 23 has an elongated body including an open front muzzle end 23*a* and opposite open rear breech end 23*b* coupled to a front end of the receiver 21 in any suitable manner. Barrel bore 23*d* extends axially between the muzzle and breach ends and defines a projectile pathway. Diametrically enlarged cartridge chamber 23*c* is defined at rear breech end 23*b* and configured for chambering a cartridge for firing in a known manner.

The firearm 20 defines a longitudinal axis LA and axial direction coinciding with the centerline of the barrel 23 and its longitudinal bore 23*d* formed therein between the muzzle and breech ends 23*a*, 23*b*.

Figure 12:
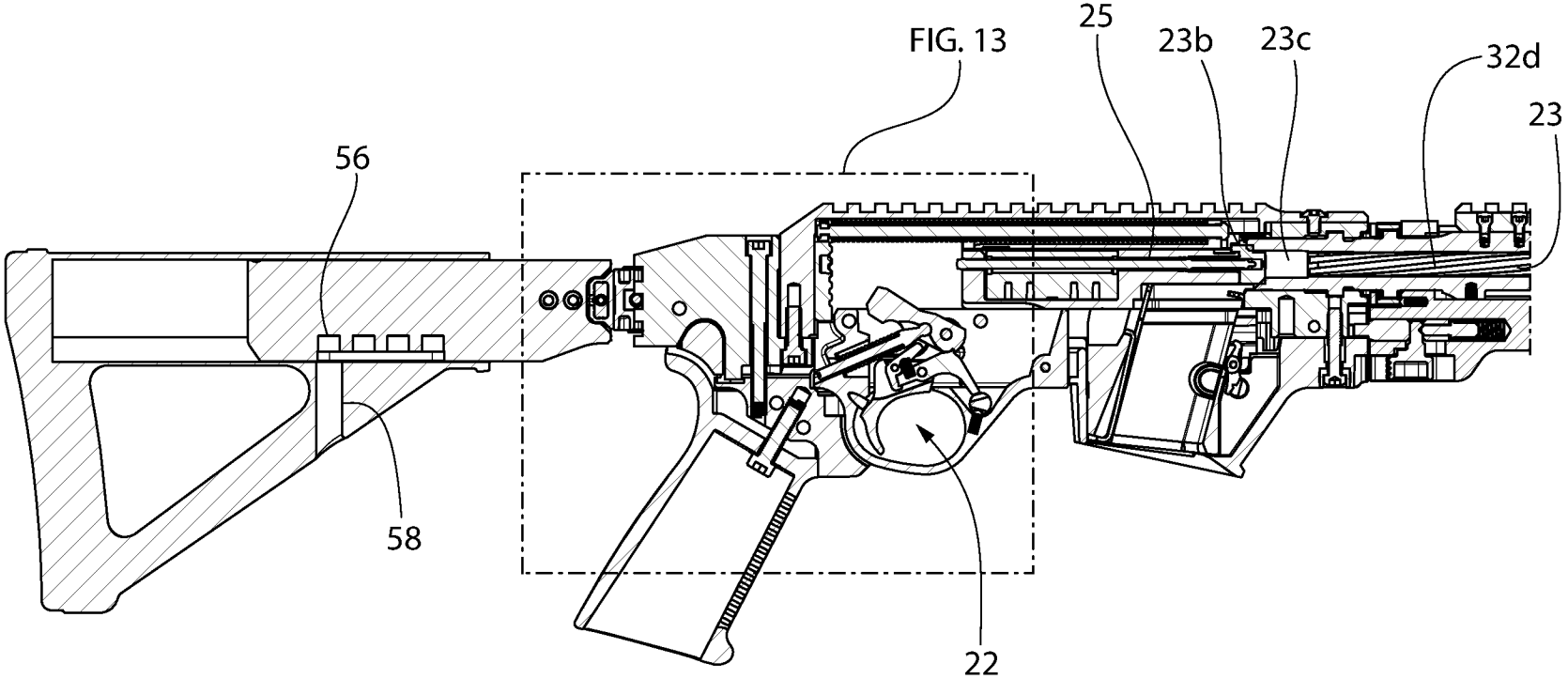
FIG. 12 is a right side partial longitudinal cross-sectional view thereof.
Figure 13:
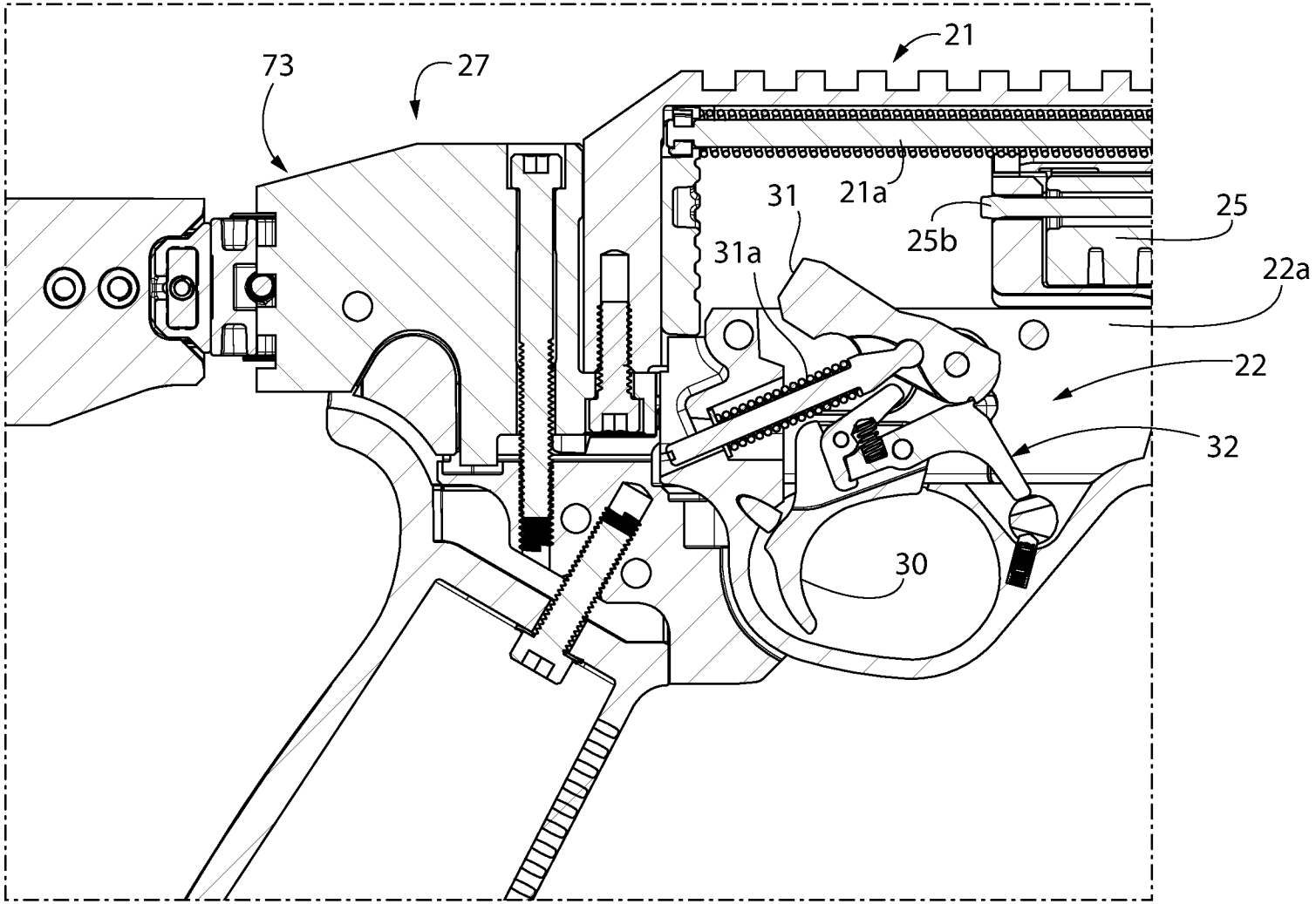
FIG. 13 is an enlarged detail therefrom.
Figure 14:
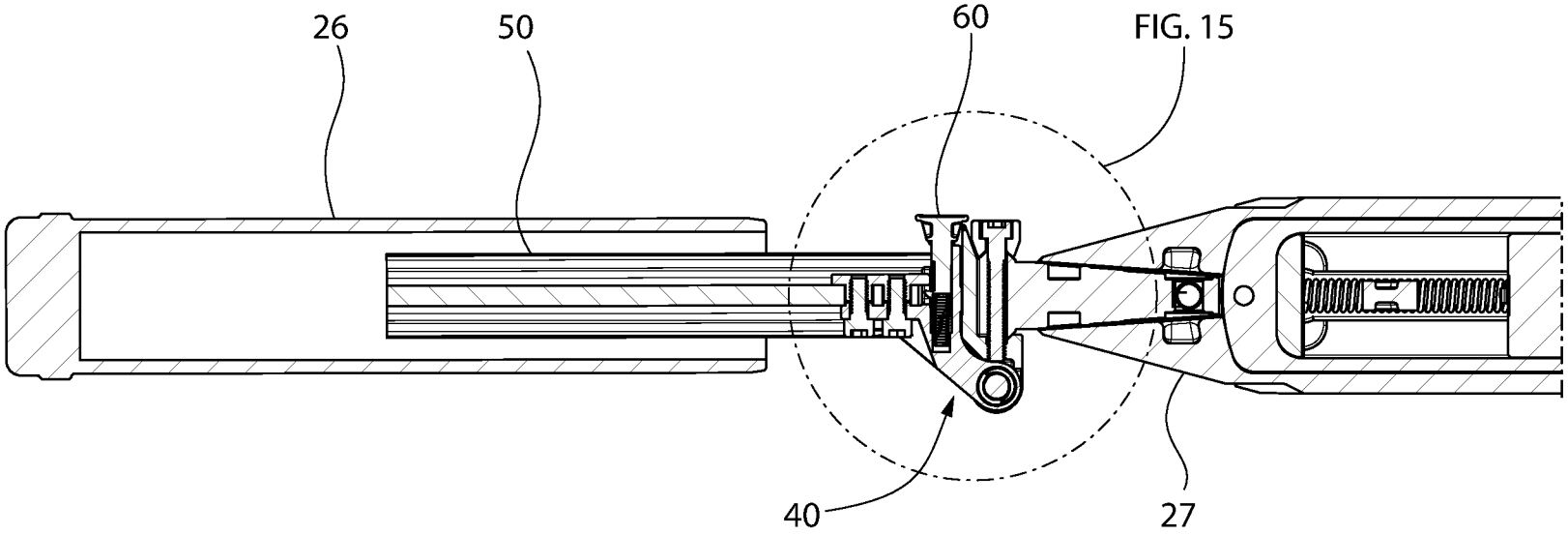
FIG. 14 is a bottom partial longitudinal cross-sectional view thereof.

The receiver 21 slideably supports an axially movable bolt assembly 25 (see, e.g. FIGS. 12-13). Bolt assembly 025 may include a laterally extending bolt handle 25*a* for manually closing or opening the breech (i.e. cycling the action). The bolt assembly 25 is slideably moveable forward/rearward in an axially extending internal cavity 21*a* of receiver 21 and includes a firing pin 25*b* (not shown) for detonating a chambered cartridge in the rear breech end 23*b* of the barrel 23 that defines the chamber; all of which is well understood by those skilled in the art without further elaboration.

Fire control mechanism 22 may be any suitable mechanism operable to cycle the action and discharge the firearm. In one embodiment best shown in FIG. 13, fire control mechanism 22 generally includes movable trigger 30 operably linked to spring-biased rotatable hammer 31 via an intermediary sear assembly 32. Sear assembly 32 is configured to selectively engage and retain hammer 31 in a ready-to-fire rear cocked position, and release the hammer to the forward firing position via trigger pull for striking firing pin 25*b* to discharge a chambered cartridge. Both hammer 31 and sear assembly 32 are rotatably and pivotably pinned to the receiver or alternatively a firing control insert 22*a* mounted in the receiver 21. Hammer spring assembly 31*a* biases hammer 31 toward the forward firing position.

The main body 27 of firearm 20 (e.g. chassis 27*a*) may be an axially elongated one-piece unitary structure in one embodiment which supports the receiver 21 and folding stock 26. Main body 27 defines a longitudinally-extending and upwardly open receiver-bedding cavity 28 for mounting the receiver 21 thereto and for housing the trigger-actuated fire control mechanism 22. The receiver may be partially received within cavity 28, wherein the upper portion of the receiver remains exposed and the lower portion is nested within the cavity in typical fashion (see, e.g. FIG. 1). Any suitable method may be used to mount the receiver 21 to the main body 27-1 of the mid-stock, such as for example fasteners (e.g. screws, bolts, pins, etc.). A downwardly open magazine well 27*b* is defined by the main body 27 which is configured for detachably mounting an ammunition magazine therein (not shown). Main body 27 may also comprise a downwardly extending pistol grip 29 in some embodiments to facilitate handling the firearm. Pistol grip 29 may be integrally formed with the main body as a unitary structural part thereof, or alternatively may be a discrete separate part coupled to the main body by any suitable means. Main body 27 further includes a trigger guard 27*c* in one embodiment.

Rear stock 26 in turn comprises a butt pad assembly 33 for shouldering and arcuately curved upper portion defining cheek rest 32. In one embodiment, rear stock 26 may be formed of a non-metallic like a polymeric material such as glass reinforced nylon or other plastics. Rear stock 26 may therefore be made by a suitable plastic molding process, such as injection molding. Other non-metallic materials, metallic materials, or combinations thereof may be used for the rear stock.

The folding stock coupling system will now be further described. FIGS. 1-15 show aspects of the stock coupling system mounted to firearm 20. FIGS. 16-47 show portions of the firearm and stock coupling system in isolation and greater detail.

Referring to the foregoing figures in general, the stock coupling system generally includes a hinge assembly or mechanism 40 for pivotably mounting rear stock 26 to the main body 27 (e.g. chassis 27*a*) of the firearm, and a clamping assembly 70 for detachably coupling the hinge mechanism to the main body.

With particular reference to FIGS. 25-26 and 39-44, hinge mechanism 30 includes a front hinge member 41 and rear hinge member 42 pivotably coupled to the front hinge member by hinge pin 43. Rear hinge member includes an elongated hinge arm 44 defining hinge barrel 44*a* which is insertable between a pair of spaced apart hinge barrels 46*a*, 46*b* on front hinge member 41. The front and rear hinge members 41, 42 are pivotably coupled together by inserting hinge pin 43 through pin aperture 44*b* in hinge barrel 44 and pin apertures 44*c*, 44*d* in hinge barrels 46*a*, 46*b*. Hinge pin 43 captures the self-contained hinge detent spring 45 within the three hinge barrels for biasing the detent mechanism, as further described herein. Hinge pin 43 may be retained in the hinge mechanism 40 by a snap ring 43*a* in some embodiment (see, e.g. FIG. 34) located below the lower hinge barrel 46*b* of the front hinge member 41 when the hinge is assembled.

Figure 15:
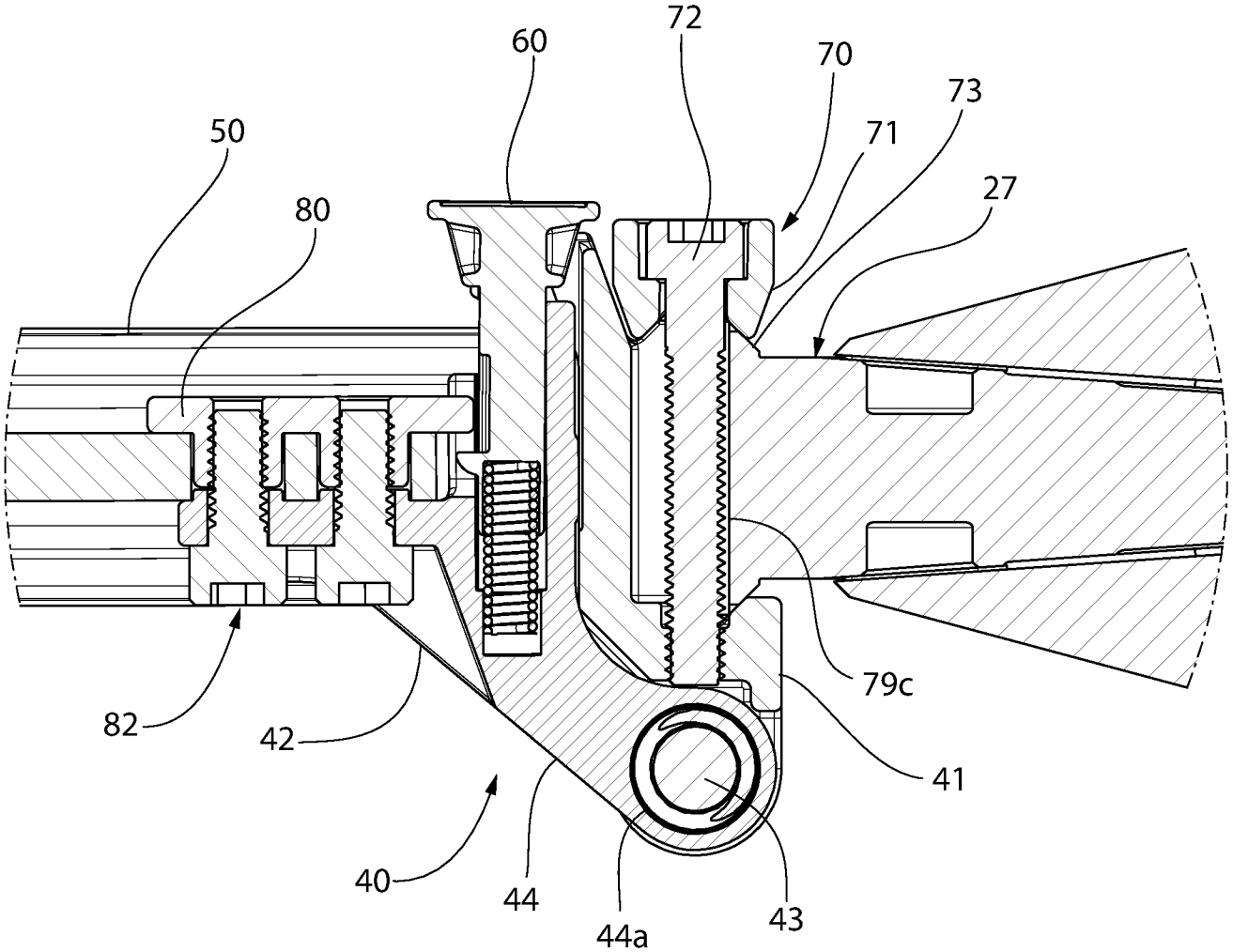
FIG. 15 is an enlarged detail therefrom.
Figure 16:
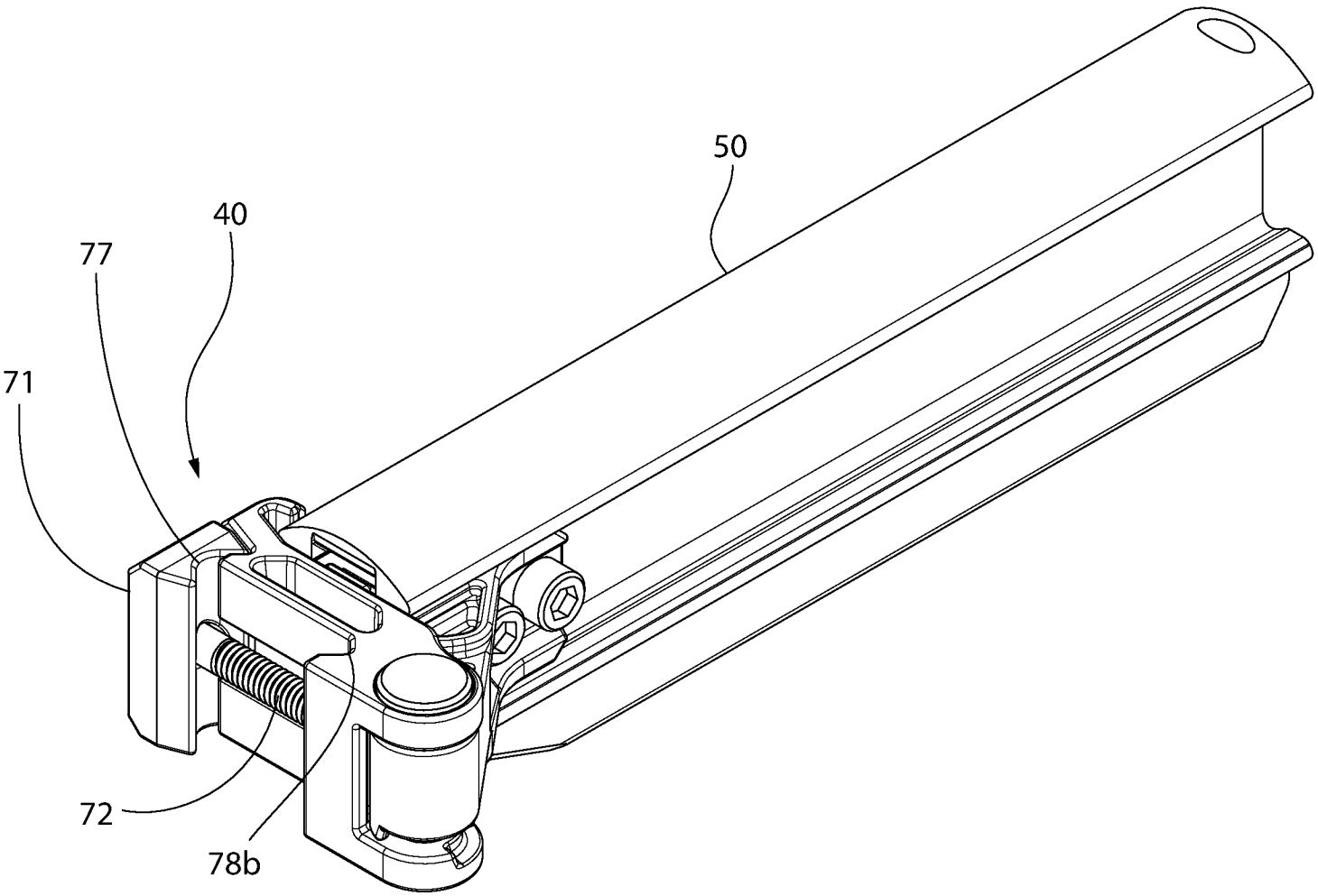
FIG. 16 is a top perspective view of the hinge mechanism of the stock coupling system of the firearm of FIG. 1.
Figure 17:
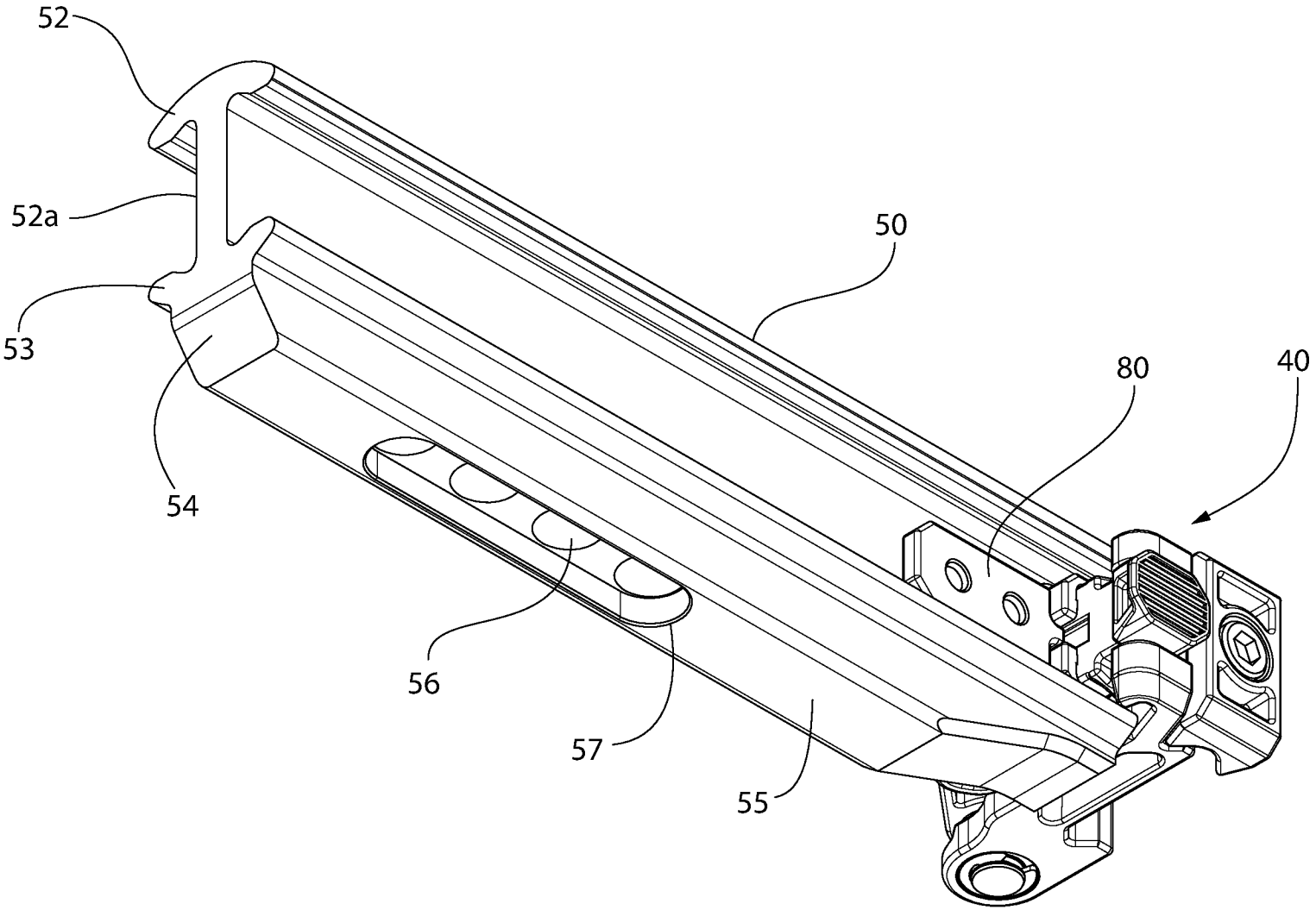
FIG. 17 is a bottom perspective view thereof.
Figure 18:
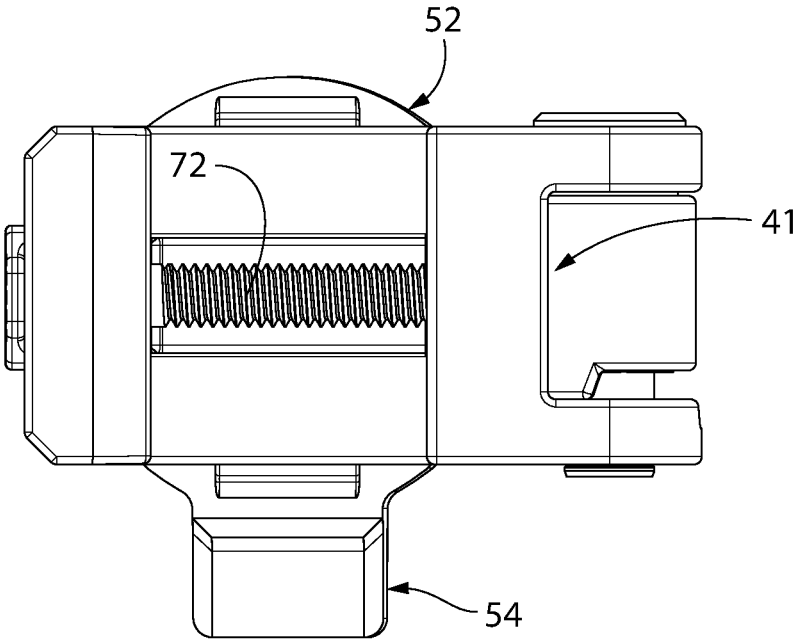
FIG. 18 is front view thereof.
Figure 19:
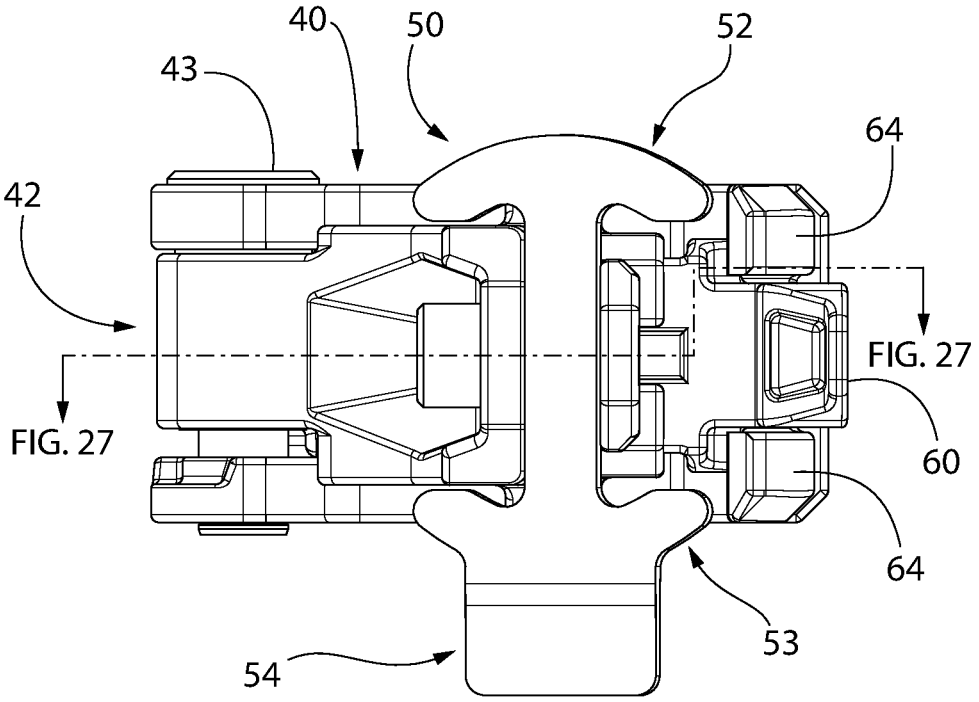
FIG. 19 is a rear view thereof.
Figure 20:
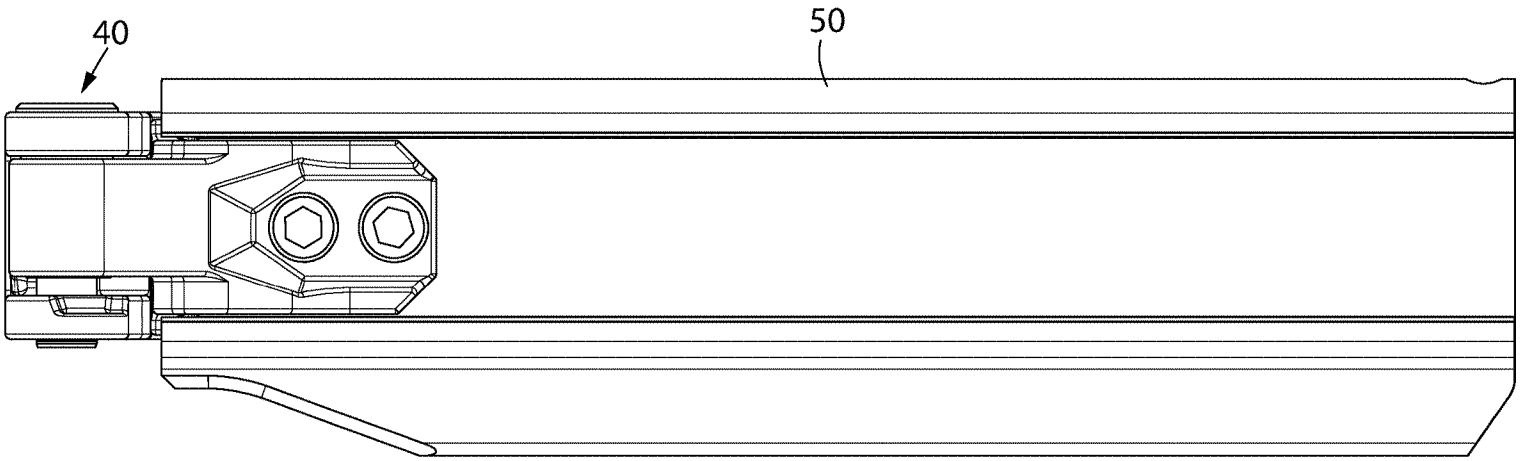
FIG. 20 is a left side view thereof.
Figure 21:
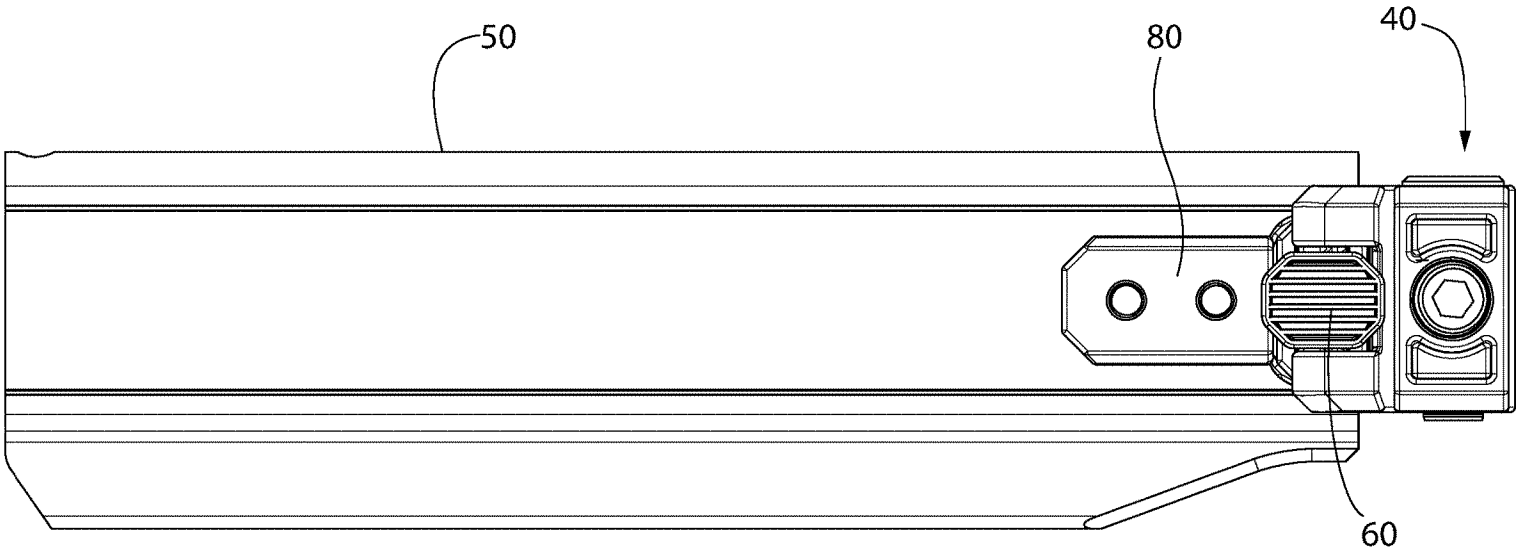
FIG. 21 is a right side view thereof.
Figure 22:
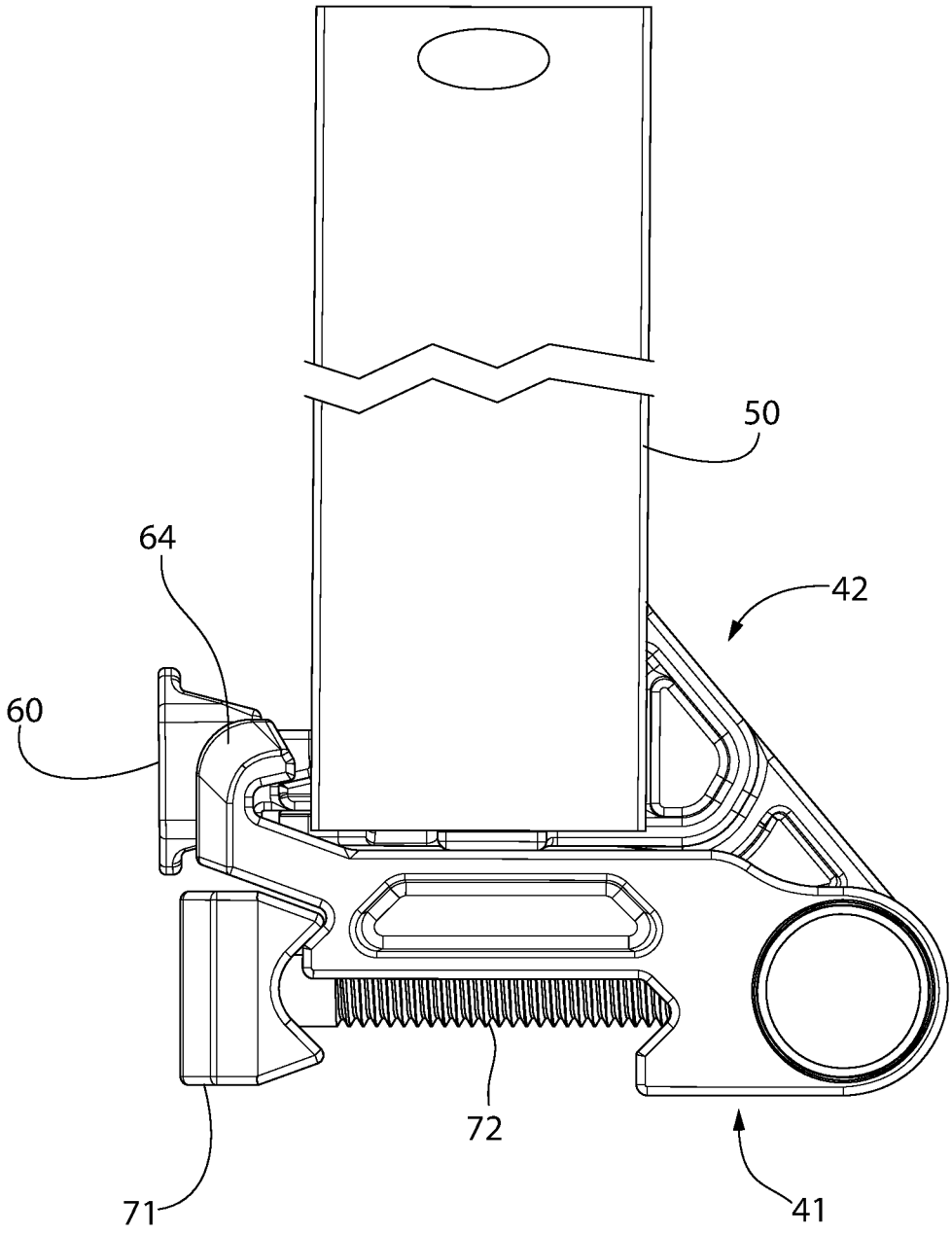
FIG. 22 is a partial top view thereof.
Figure 23:
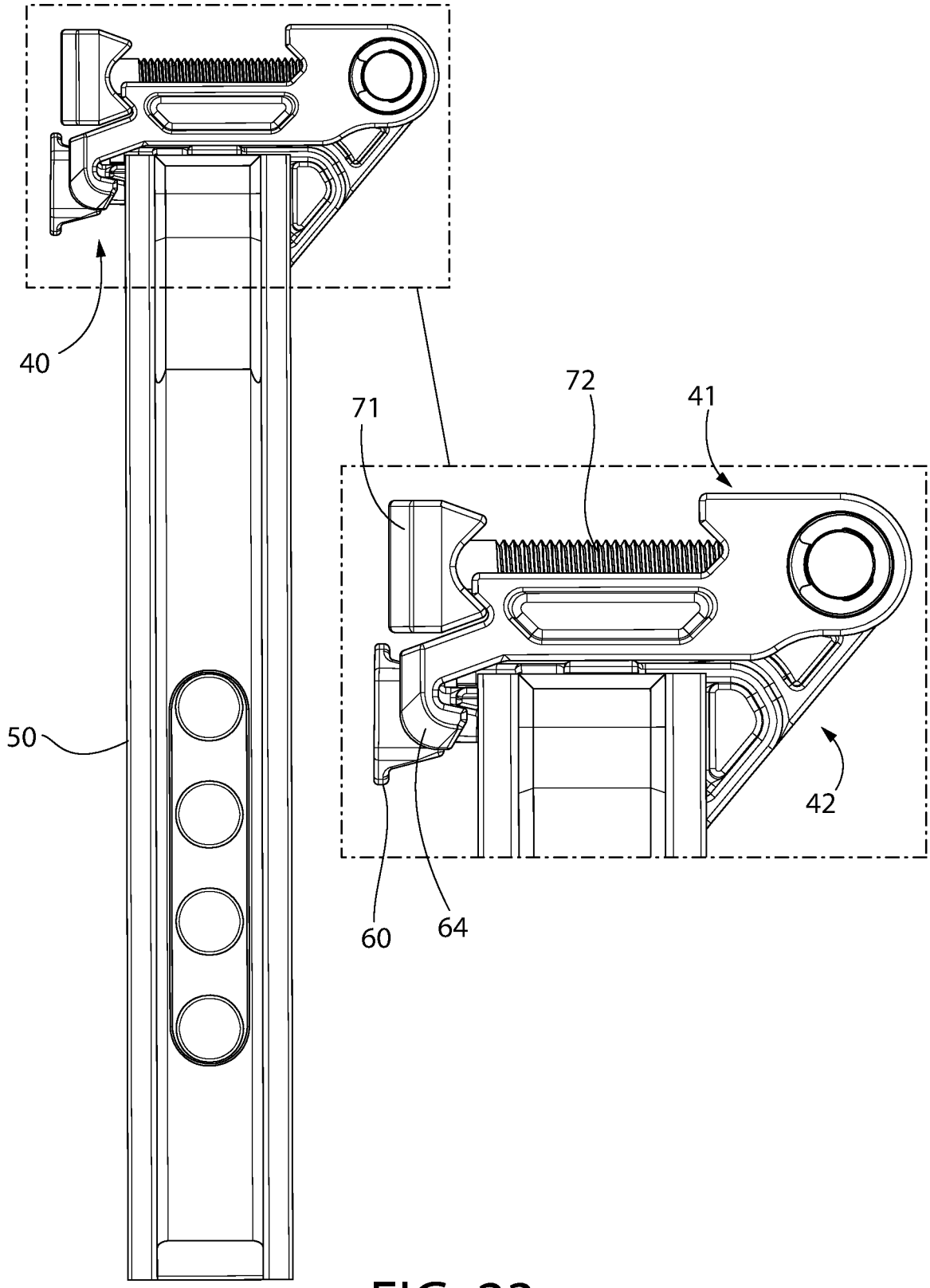
FIG. 23 is a bottom view thereof.
Figure 24:
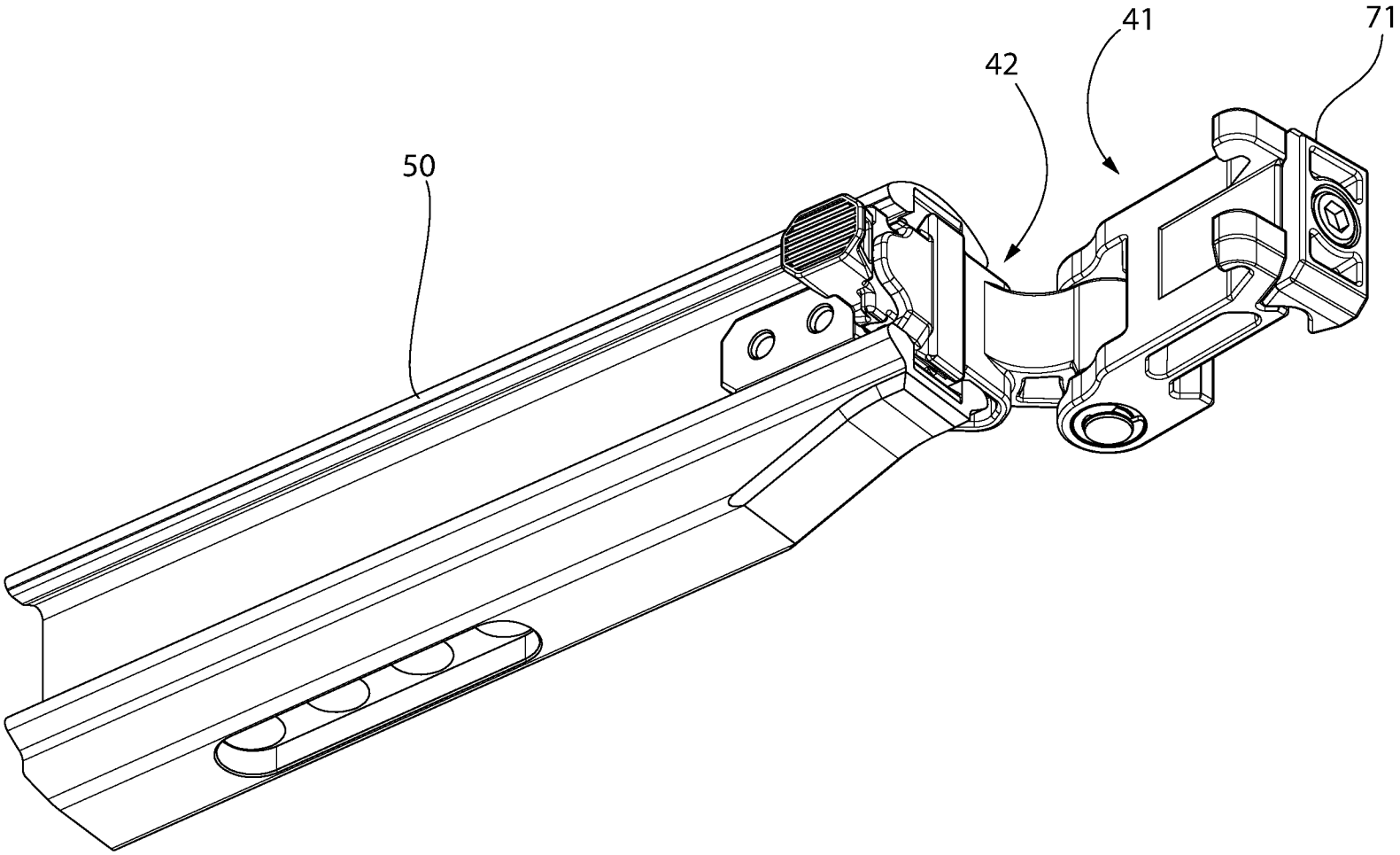
FIG. 24 is a bottom perspective view thereof.
Figure 25:
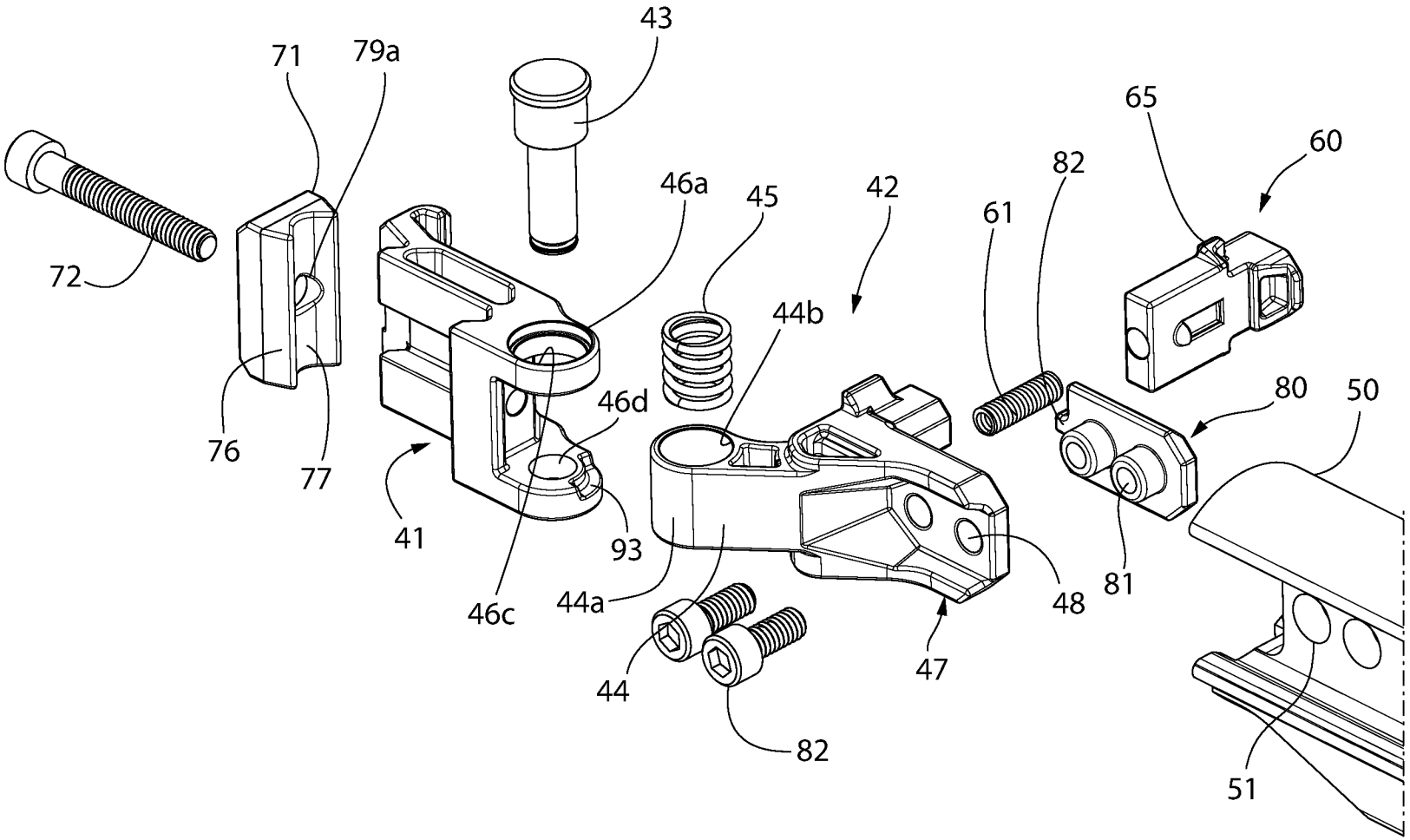
FIG. 25 is an exploded top perspective view of the hinge mechanism.
Figure 26:
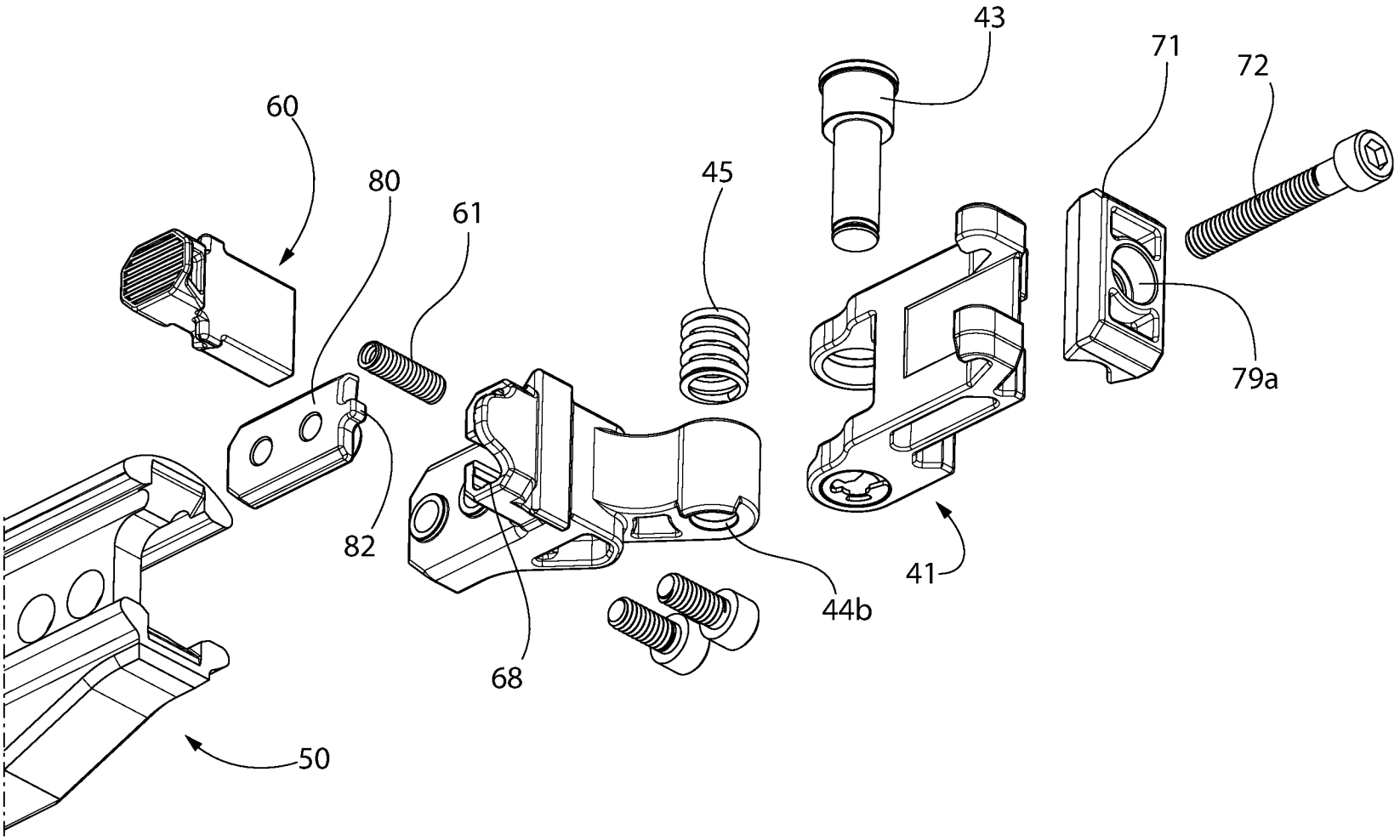
FIG. 26 is an exploded bottom perspective view thereof.
Figure 27:
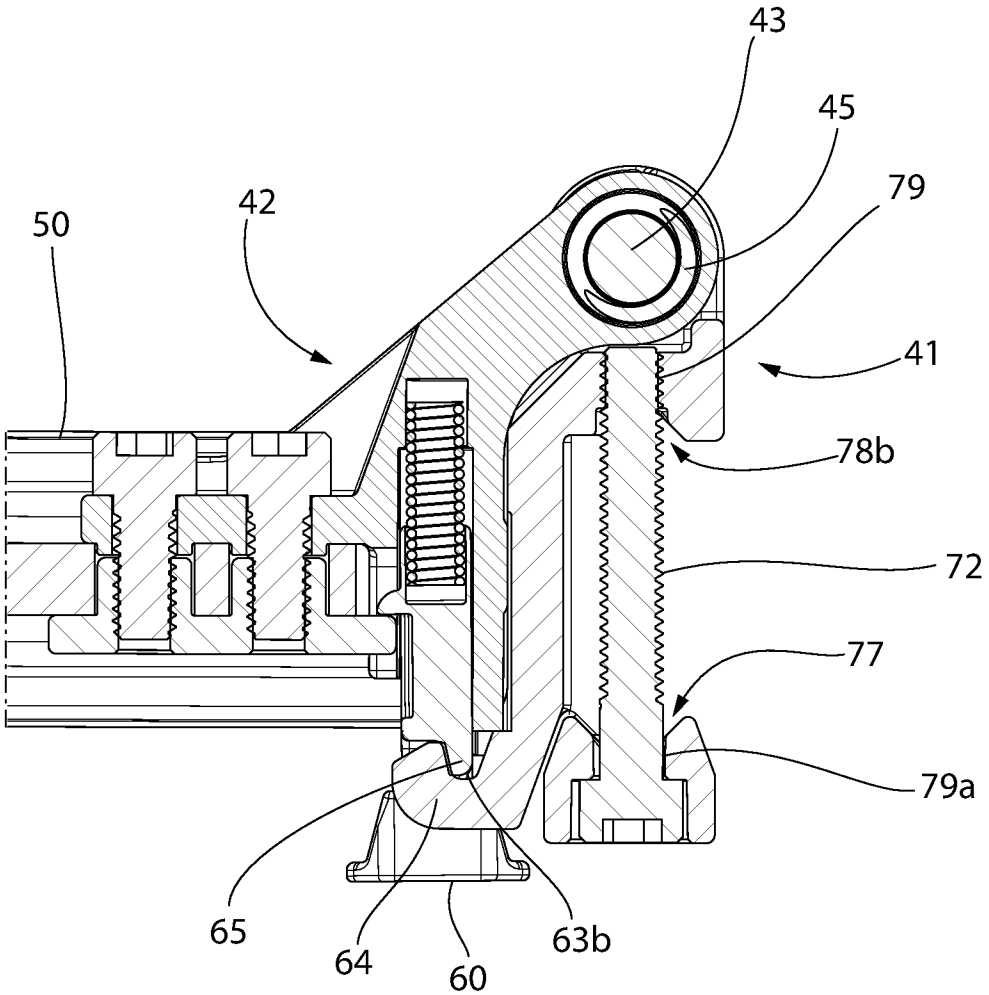
FIG. 27 is a transverse cross sectional view thereof showing the hinge in a closed locked condition.
Figure 28:
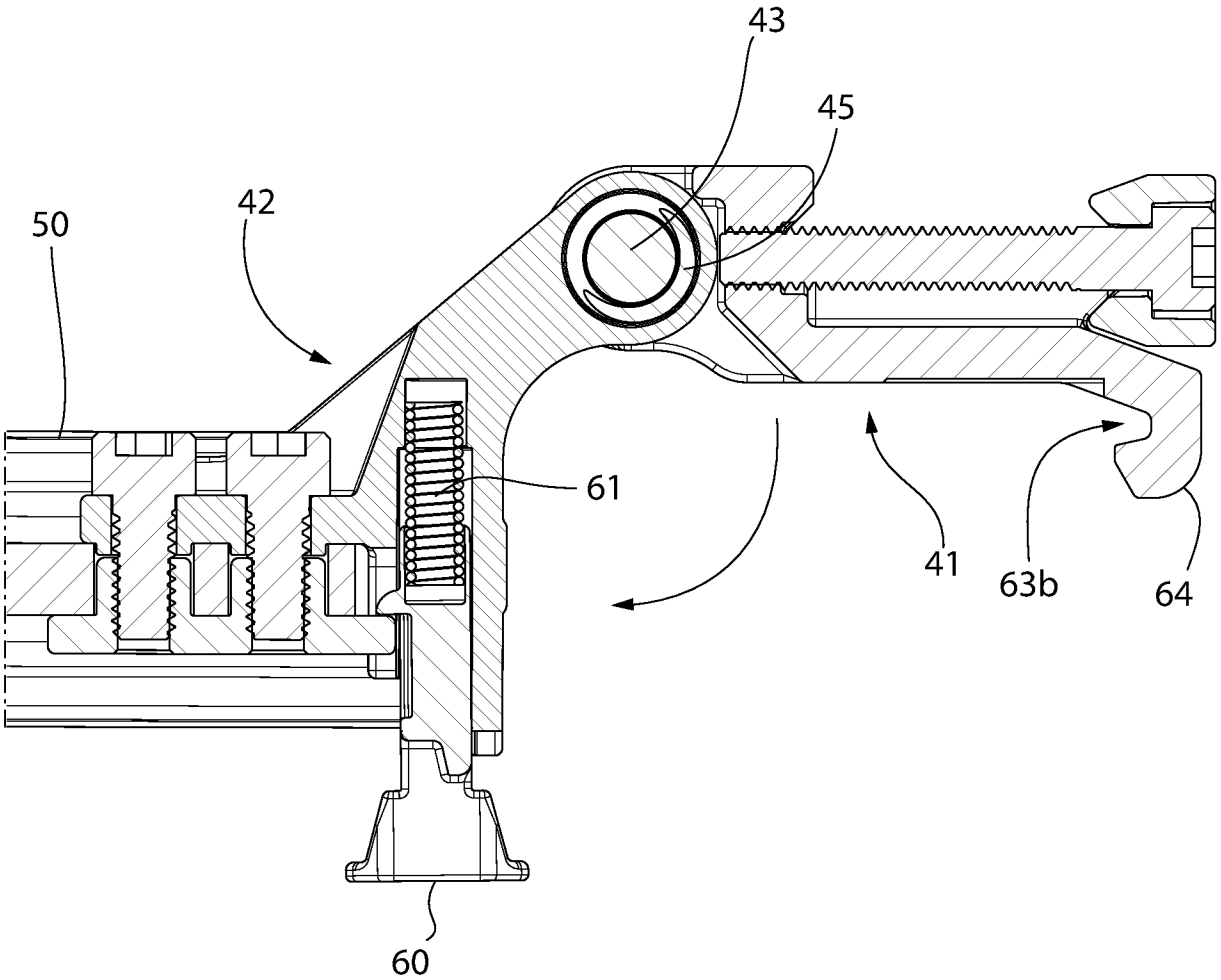
FIG. 28 is a transverse cross-sectional view thereof showing the hinge in an open unlocked condition.

Hinge arm 44 projects forwards and transversely laterally outwards from the body of the rear hinge member 42 (see, e.g. FIG. 15 et al.). This places the pivot axis for rotating the rear hinge member 42 (defined by hinge pin 43) and rear stock 26 coupled thereto offset from the longitudinal axis LA of firearm 20. This allows the rear stock to be folded forward alongside the main body 27 of the firearm.

The body of rear hinge member 42 further includes a rear coupling portion 47 configured for fixedly coupling rear mounting extension 50 thereto. Rear mounting extension 50 has a longitudinally elongated rail-like body configured for slideably mounting one of a plurality of different rear stocks 26 thereto each sharing a common mounting interface, as further described herein. To accomplish the coupling, rear coupling portion 47 includes a pair of fastener apertures 48 which receive threaded fasteners 82 (e.g. bolts/screws) therethrough inserted from a first lateral side of the rear hinge member 42 (e.g. left side in the figures). Fasteners 82 engage threaded sockets 81 formed on a retention plate 80 mounted on an opposite second lateral side of the rear hinge member (e.g. right side in figures). Mounting extension 50 includes a forward portion defining a pair of fastener apertures 51 which become concentrically aligned with fastener apertures 48 on rear hinge member 42 when the mounting extension is placed against the right side of the rear hinge member. The rear mounting extension 50 is sandwiched and trapped between the retention plate 80 on one side and the rear coupling portion 47 of the hinge member 42 on the other side to detachably couple the extension to the hinge member when the fasteners 82 are tightened. Other means for detachably coupling the rear mounting extension to the rear hinge member may be used.

Hinge mechanism 40 is selectively movable by the user between a locked condition in which the rear hinge member 42 is lockingly engaged with and not movable relative to the front hinge member 41, and an unlocked condition in which the rear hinge member is lockingly disengaged from and movable relative to the front hinge member. The terms lockingly engage or disengaged connotes physically interaction between the front and rear hinge members which should not be confused with and is unrelated to their pinned pivotable coupling together via hinge pin 43.

To accomplish the foregoing locked and unlocked conditions of the hinge mechanism, the rear hinge member 42 in one embodiment comprises an manually-operated actuator in the form of an actuating button 60 configured to automatically lock the rear hinge member to the front hinge member 41 in the locked condition of the hinge mechanism 40. Actuating button 60 is slideably mounted to the rear hinge member and manually depressible by the user. The actuating button is linearly movable between an outward position in which the actuating button is lockingly engaged with the front hinge member 41, and an inward position disengaged from the front hinge member. Operating spring 61 biases the actuating button towards the engaged outward position. Spring 61 may be a helical compression spring in one embodiment as shown; however, other types of springs may be used.

To form the foregoing engaged and locked relationship with the front hinge member 41, actuating button 60 comprises a pair of first tapered locking surfaces 62 mutually engageable with a corresponding pair of second tapered locking surfaces 63 of the front hinge member when the actuating button is in the outward position. FIGS. 39-42 show front hinge member 42 and actuating button 60 in isolation and greater detail. The first tapered surfaces are spaced apart on the actuating button and the second tapered surfaces are spaced apart on the front hinge member 41 to create a balanced locking force therebetween when the hinge mechanism is in the locked condition. As opposite to single mating lockup surfaces, the double locking surfaces advantageously prevent the rear hinge member 42 and rear stock 26 coupled thereto from becoming unlocked in the even the firearm is jarred or dropped.

Figure 43:
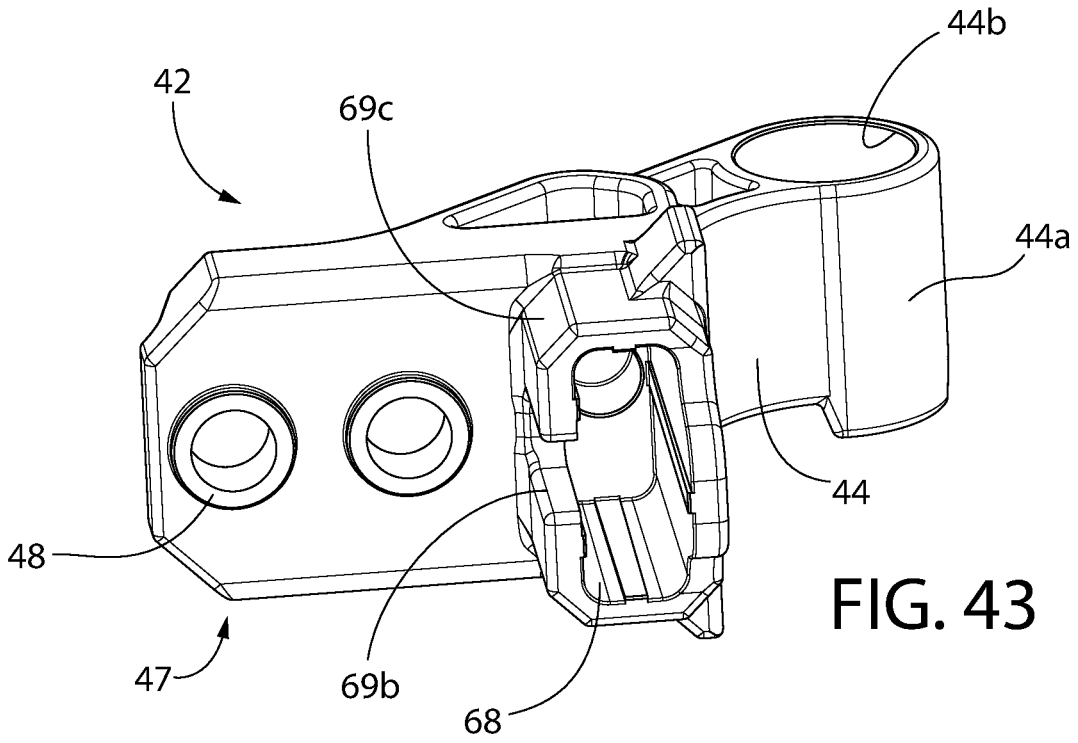
FIG. 43 is a top perspective view of the rear hinge member of the hinge mechanism.
Figure 44:
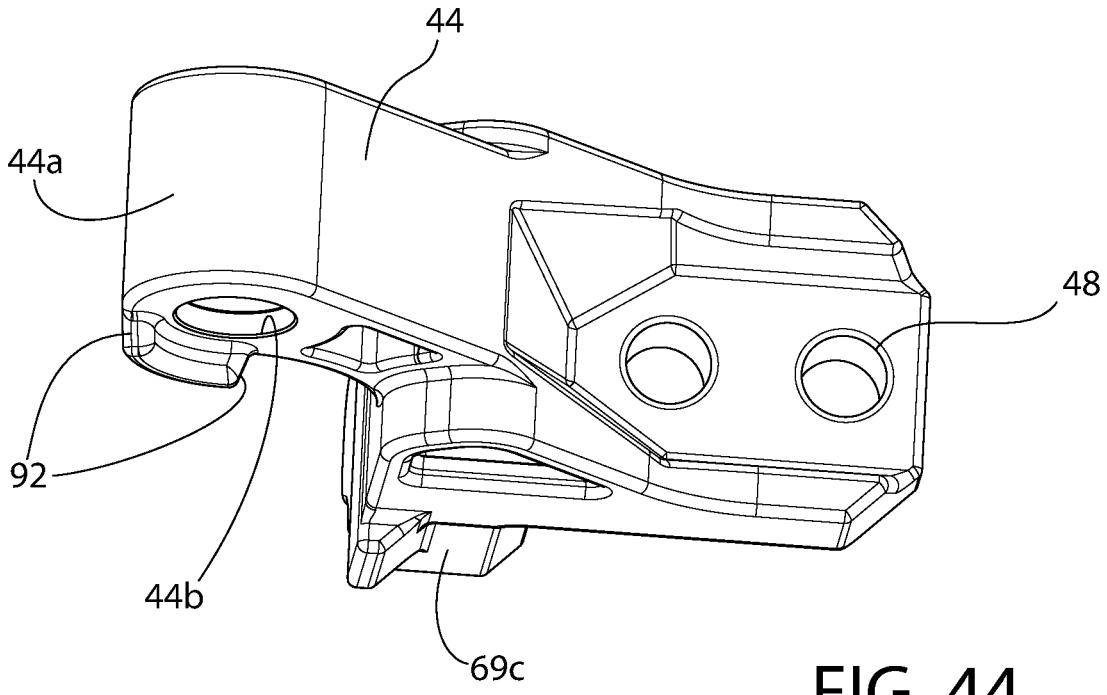
FIG. 44 is a bottom perspective view thereof.

The actuating button 60 comprises an elongated actuator body comprising an inboard mounting portion 66 slideably mounted in a laterally open mounting cavity or receptacle 68 of rear hinge member 42 (best shown in FIG. 43). The receptacle 68 may be formed in an enlarged mounting boss 69*c* which projects perpendicularly outwards from rear coupling portion 47 of rear hinge member 42. Operating spring 61 of actuating button 60 is disposed inside receptacle 68 to engage the mounting portion 66 of the button. Receptacle 68 and mounting portion 66 may have complementary configured cross-sectional shapes. In one embodiment, mounting portion 66 has a rectangular cuboid configuration and receptacle has a rectangular cross-sectional shape. Other shapes and configurations of the mounting portion and receptacle may be used in other embodiments.

The actuator body further comprises an outboard enlarged actuating end 67 protruding outwards from the rear hinge member 42 and accessible to a user for pressing the actuating button 60 inwards to unlock the hinge mechanism 40. Actuating end 67 has a greater width than the narrower mounting portion 66 to facilitate positive engagement by a user's finger or thumb. The outward facing surface of the actuating end 67 may therefore be textured (e.g. ribs, serrated, knurled, etc.) to promote a non-slip engagement by the user to actuate the button. The actuating end 67 is the exposed portion of the actuating button 60 while the mounting portion 66 is substantially unexposed and nested inside the rear hinge member 42 in receptacle 68.

Figure 41:
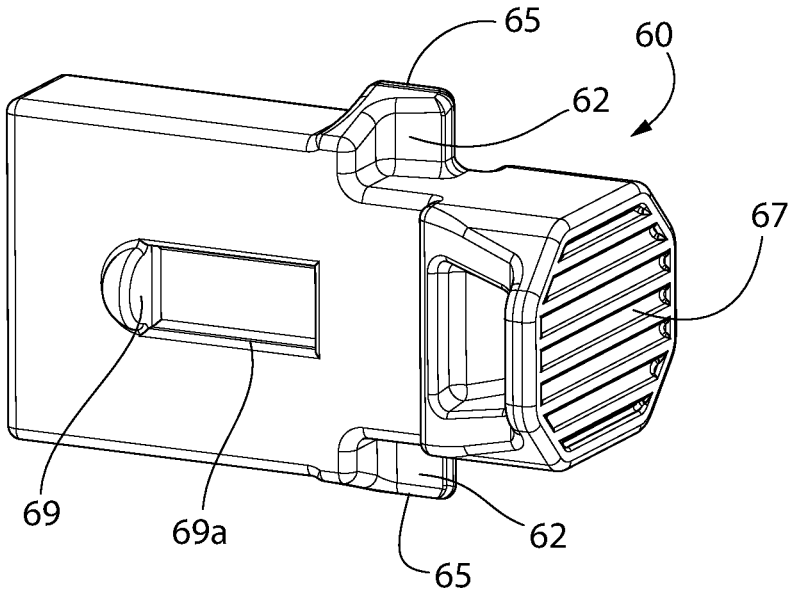
FIG. 41 is a top perspective view of the actuating button of the hinge mechanism.
Figure 42:
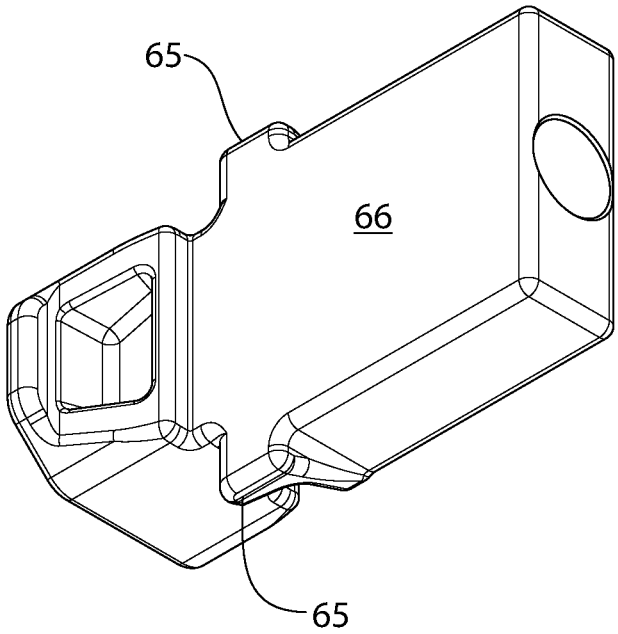
FIG. 42 is a bottom perspective view thereof.

In one embodiment, the first tapered locking surfaces 62 of the actuating button 60 may be formed by a pair of locking tabs or protrusions 65 extending outwards from the body of the button (e.g. mounting portion 66) in opposite directions as shown (see, e.g. FIGS. 41-42). The corresponding second tapered locking surfaces 63 in turn may be formed on a pair of hook-shaped locking protrusions 64 spaced apart on the front hinge member 41. Locking protrusions 64 may have a recurvant shape as shown (see, e.g. FIGS. 39-40) defining locking recesses 69*b* which face inwardly to lockingly receive and engage locking protrusions 65 on actuating button 60 when the hinge mechanism is in the locked condition. Locking protrusions 64 are formed on an opposite end of the front hinge member 41 than the hinge barrels 46*a-b*. It bears noting that the locking protrusion 64 remain stationary when the hinge mechanism 40 is operated since the front hinge member 41 is fixedly coupled to the rear of the main body 27 of firearm 20. The locking protrusions 65 on actuating button 60 rotate in an arcuate path relative to the front hinge member and locking protrusions 64 thereon. Actuating end 67 of actuating button 60 is disposed between the locking protrusions 64 of the front hinge member when the hinge mechanism is in the locked condition (see, e.g. FIGS. 17, 21, and 29). The actuating end 67 therefore into and out of the gap between locking protrusions 64 on the front hinge member when the rear hinge member 42 is swung in an arcuate path about hinge pin 43 between closed and open positions, respectively.

In one embodiment, the retention plate 80 previously described which is used to couple the stock rear mounting extension 50 to rear hinge member 42 may be configured to also prevent operating spring 61 from ejecting actuating button 60 out of its mounting receptacle 68*k*, thereby beneficially serving dual functions. To accomplish this, retention plate 80 includes a retention protrusion 82 which engages a corresponding retention tab 69 on the actuating button 60 to prevent ejection of the actuating button (see, e.g. FIGS. 25-26 and 41-42). Tab 69 engages retention protrusion 82 when the retention plate 80 is coupled to the rear hinge member 42. The mounting portion 66 of the actuating button body may include an elongated travel window 69*a* which receives the retention protrusion 82 of the retention plate. The window allows the retention protrusion 82 to slide back and forth therein when the actuating button 60 moves inwards against the biasing action of spring 61 as the user depresses the button, and outwards as spring returns the button to its outwardly biased position when the user releases the button. The retention tab 69 located adjacent to inside end of the travel window 69*a* acts as a travel stop for the actuating button 60 in addition to preventing its ejection from the rear hinge member 42. To allow the retention protrusion 82 of retention plate 80 access travel window 69*a*, the button mounting boss 69*c* of the rear hinge member 42 includes a corresponding elongated access window 69*b* (see, e.g. FIG. 43) which may have a length at least coextensive with the length of travel window 69*c* in some embodiments. Retention tab 69 of actuating button 60 slideably travels inwards and outwards within access window 69*b* when the button is actuated.

The coupling mechanism used for detachably coupling the hinge mechanism 40 to the main body 27 of firearm 20 will now be described in greater detail. Referring initially in general to FIGS. 1-40, the front hinge member 41 comprises a tightenable clamp assembly 70 configured for detachable coupling to a double-wedge shaped Picatinny rail segment 73 on the rear end of the firearm main body 27. The wedge-shaped Picatinny rail profile is a well-known accessory attachment rail system in the firearm arts without need for undue elaboration. Rail segment 73 is vertically oriented in one embodiment and comprises a pair of wedge-shaped edges 74 opposite each other which extend laterally outwards right and left (see, e.g. FIGS. 29 and 34-37). Front hinge member 41 includes a pair of vertically spaced apart fixed wedges 75 formed integrally with the hinge member (best shown in FIGS. 39-40). Each wedge 75 defines an outward facing V-shaped notch 78 which receives and engages one of a pair of wedges 76 of a detachable clamping member 71, which in turn defines an inward facing V-shaped notch 77 therebetween (see FIG. 25). V-shaped notch 77 of the clamping member also receives and engages one of the wedge-shaped edges 74 of the rail segment 73.

Front hinge member 41 further comprises another fixed wedge 75*a* at its hinge barrel area which defines an inward facing V-shaped notch 78*b* which receives and engages the remaining wedge-shaped edge 74 on the opposite side of the rail segment 73. A through hole 79*a* formed in clamping member 71 within the V-shaped notch 77 receives a threaded fastener 72 (e.g. bolt/screw) therethrough. The threaded shaft of fastener 72 passes through a laterally elongated fastener passage 78*a* in the front hinge member 41 and rotatably engages a threaded bore 79*b* formed in barrel area of the hinge member which receives hinge pin 43 (see, e.g. FIGS. 25-28 and 39-40).

Figure 29:
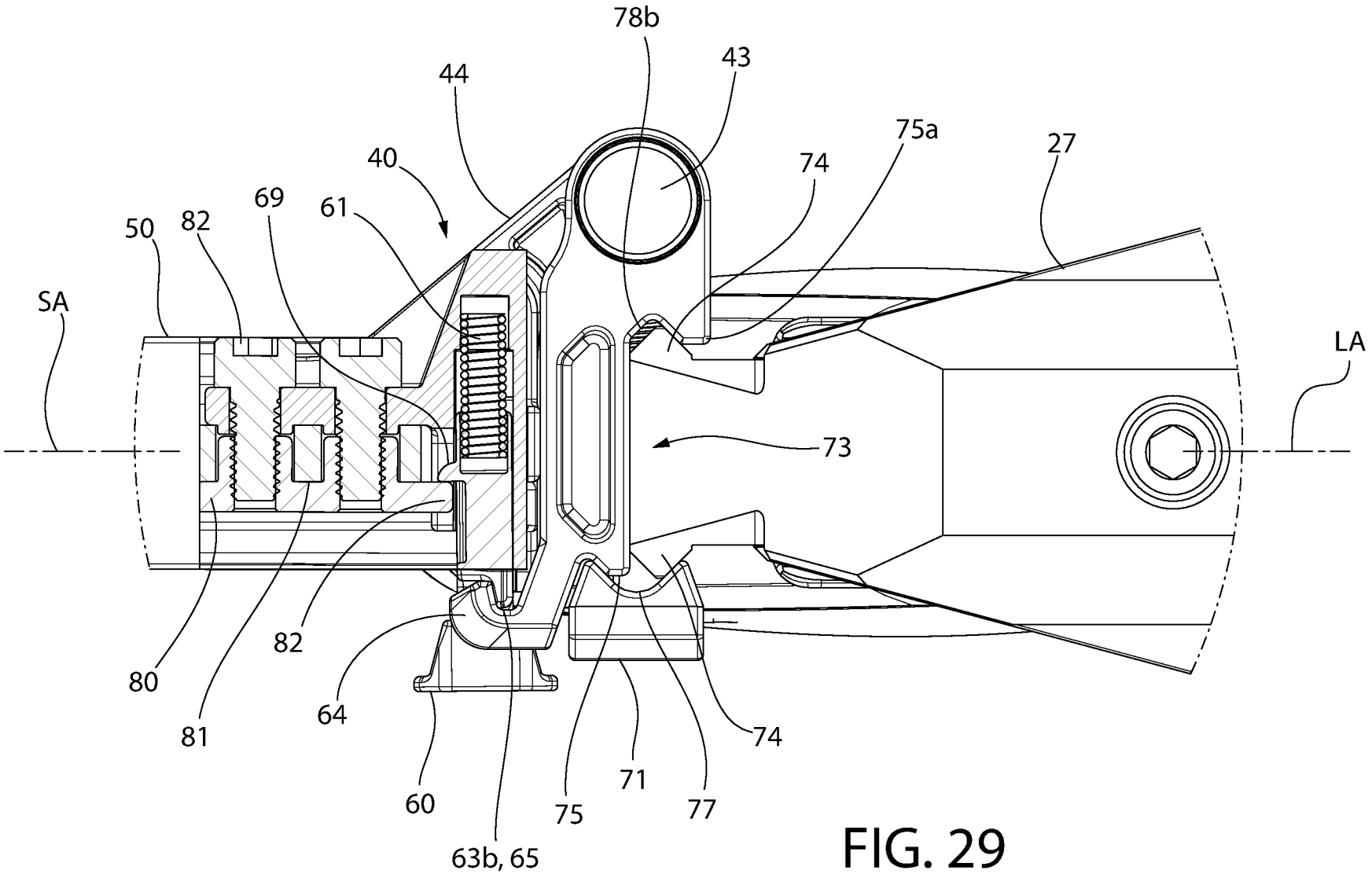
FIG. 29 is a first sequential transverse cross sectional view showing the hinge mechanism in a closed and locked condition.

In operation to mount the hinge mechanism 40 to the firearm main body 27, one wedge-shaped edge 74 of the Picatinny rail segment 73 is first inserted into notch 78*b* on front hinge member 41. The clamping member 71 is then positioned over and onto the remaining wedge-shaped edge 74 of rail segment 73 and wedges 75 of the front hinge member 41 which are both received in notch 77 of the clamping member. Threaded fastener 72 is then inserted through clamping member 71 and a transversely oriented fastener hole 79*c* formed through the Picatinny rail segment 73 to engage threaded bore 79*b* on front hinge member 41. The fastener is tightened which fixedly secures the hinge mechanism 40 to the firearm main body 27 in a rigid manner as shown in FIG. 29 et al. To dismount the hinge mechanism for mounting to another firearm with a similar Picatinny rail mounting interface, the process is simply reversed.

Referring generally to FIGS. 1-38 and 45-46, the rear mounting extension 50 fixedly coupled to the rear hinge member 42 as previously described herein extends rearward from the rear hinge member when the hinge mechanism is in the locked condition and defines a stock axis SA. The mounting extension 50 and concomitantly rear stock 26 mounted thereto is pivotably movable between (1) an unfolded inline position relative to the main body 27 and longitudinal axis LA of the firearm for firing (see, e.g. FIGS. 9-10), and a folded offset position for storage/carrying (FIG. 11). Stock axis SA is parallel and substantially coaxial with the longitudinal axis LA falling within at least the same vertical plane which extends through the longitudinal axis. In the folded offset position, the stock extends forward from the hinge mechanism 40 and may be positioned generally parallel to longitudinal axis LA alongside firearm main body 27. Stock axis SA may be parallel to but laterally offset from longitudinal axis LA.

To retain the stock 26/rear mounting extension 50 in the folded offset position, a detent mechanism 90 is provided. FIGS. 35-37, 39-40, and 43-44 show various features of the detent mechanism. The detent mechanism comprises detent protrusion 91 formed at the bottom of the rear hinge member hinge barrel 44*a* which is selectively insertable into a mating detent recess 93 formed in the lower hinge barrel 46*b* of the front hinge member 41. Protrusion 91 defines a pair of side tapered detent surfaces 92 engageable with a mating pair of detent surfaces 94 formed at the sides of the detent recess. Detent spring 45 coiled around hinge pin 43 biases the hinge barrel 44*a* of rear hinge member 42 and detent protrusion 91 formed thereon downwards into the detent recess 93 when the stock is folded. Spring 45 provides a vertically reciprocating piston action when the stock is moved between the unfolded and folded positions. Hinge barrel 44*a* of the rear hinge member is therefore vertically displaceable relative to the hinge barrels 46*a-b* of front hinge member 41.

Figure 35:
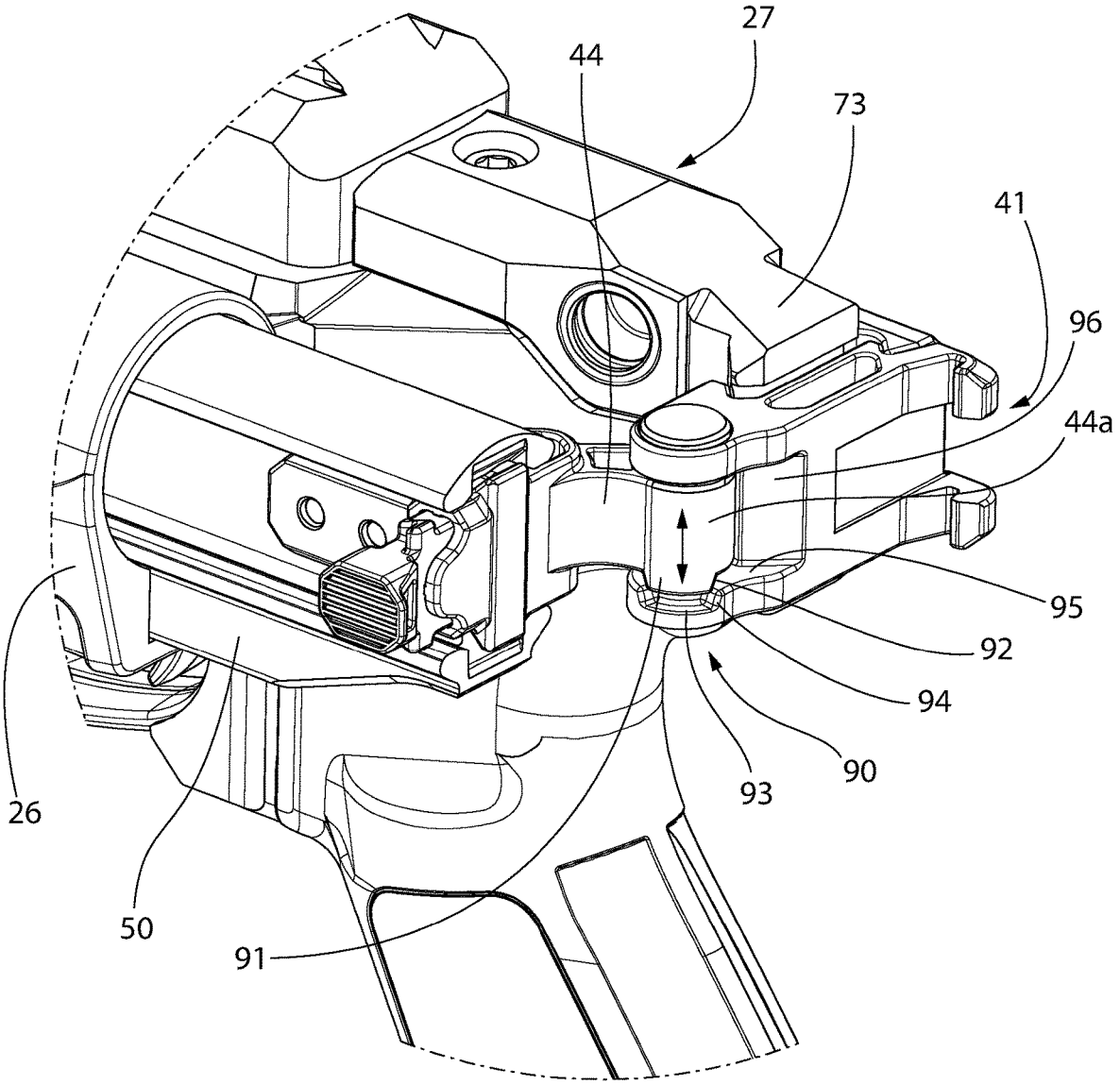
FIG. 35 is rear perspective view of the firearm showing the hinge mechanism in a fully open unlocked condition and the rear stock in a folded offset position, the detent mechanism being shown in a first disengaged position.
Figure 36:
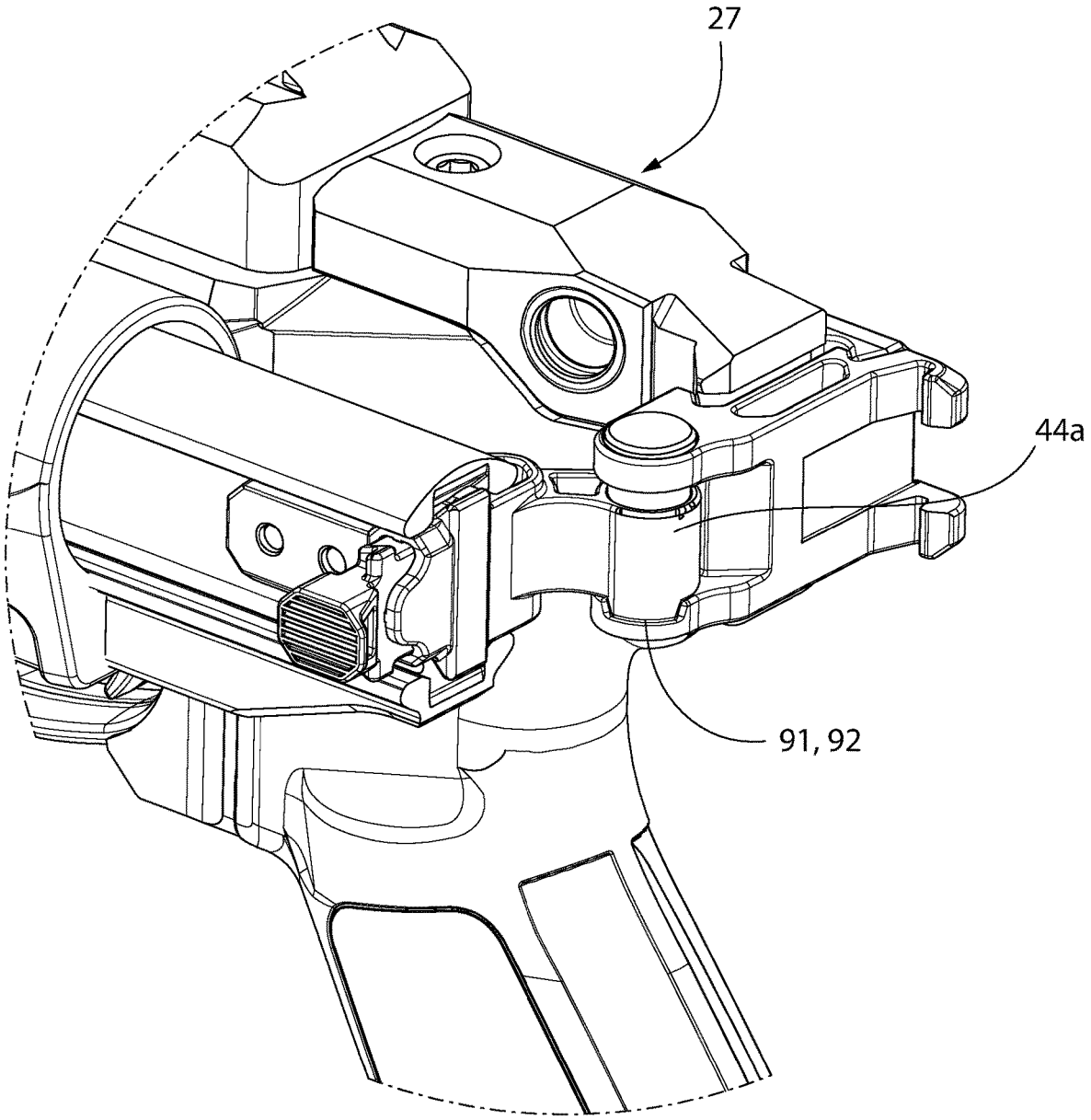
FIG. 36 is a rear perspective view thereof showing the detent mechanism in a second engaged position to retain the folded offset of the rear stock.
Figure 37:
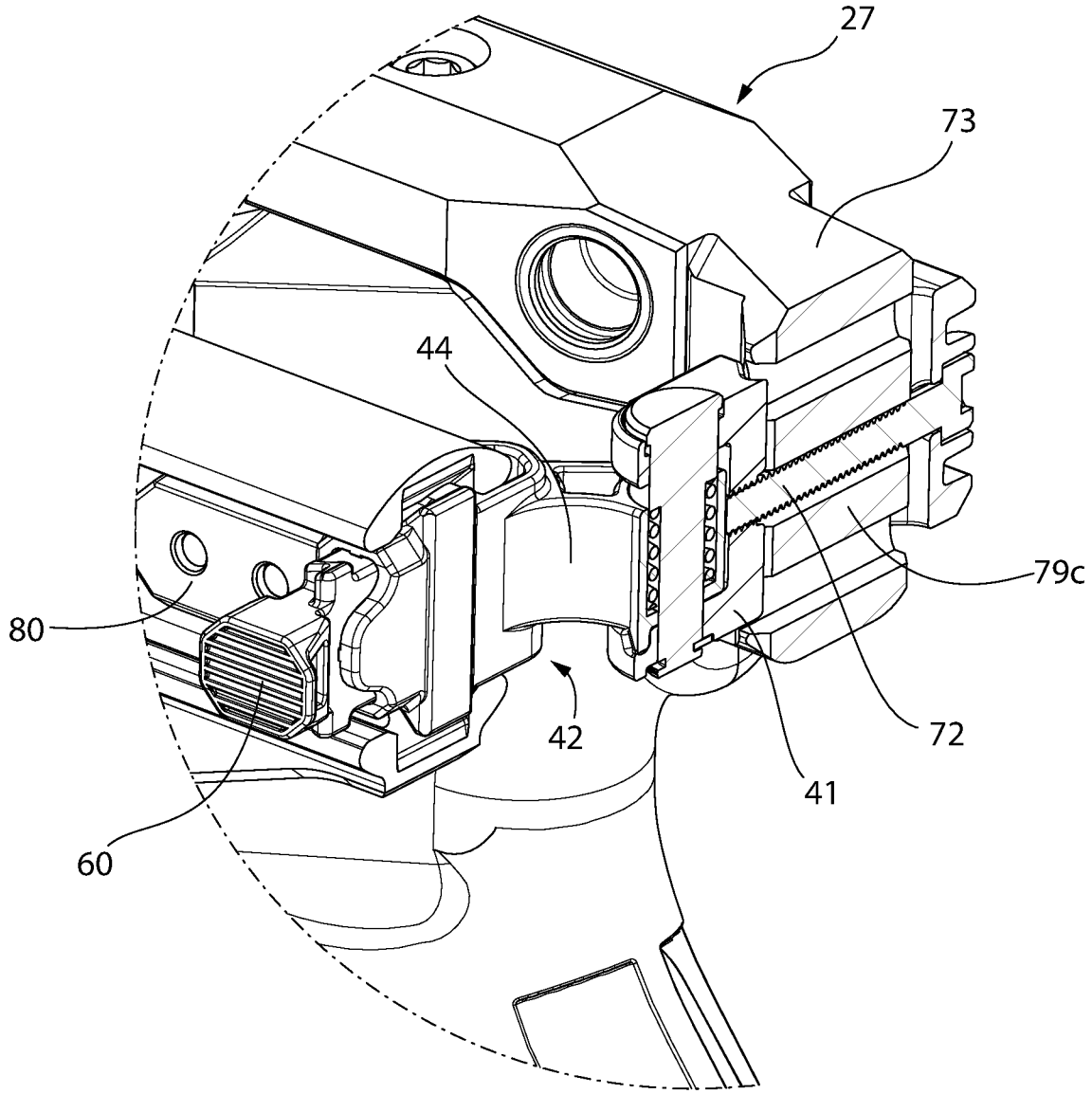
FIG. 37 is a rear perspective view thereof showing a cross-sectional view of the hinge mechanism and detent mechanism in the engaged position.
Figure 38:
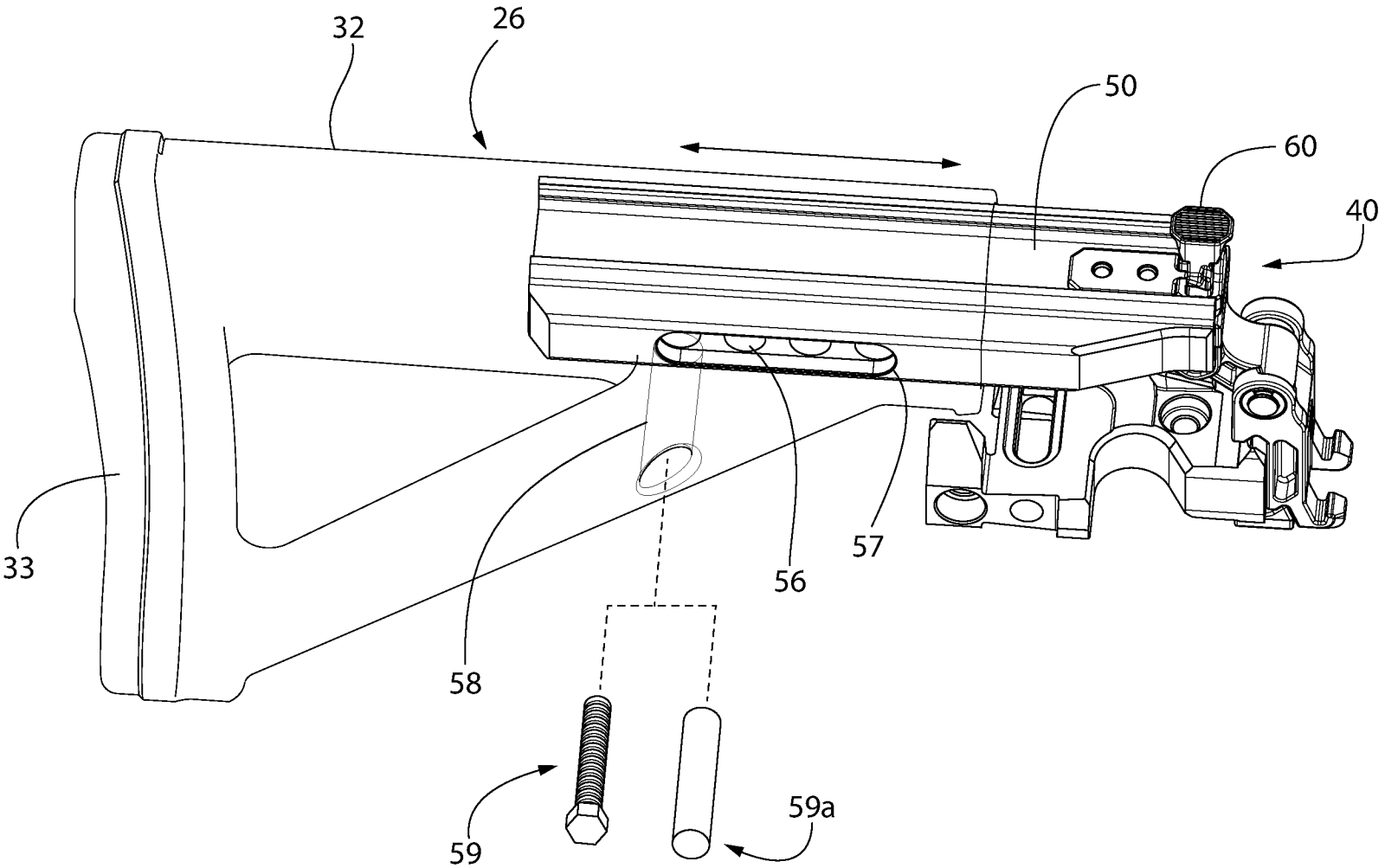
FIG. 38 is a bottom perspective view of the hinge mechanism showing aspects of the rear stock mounting system.
Figure 39:
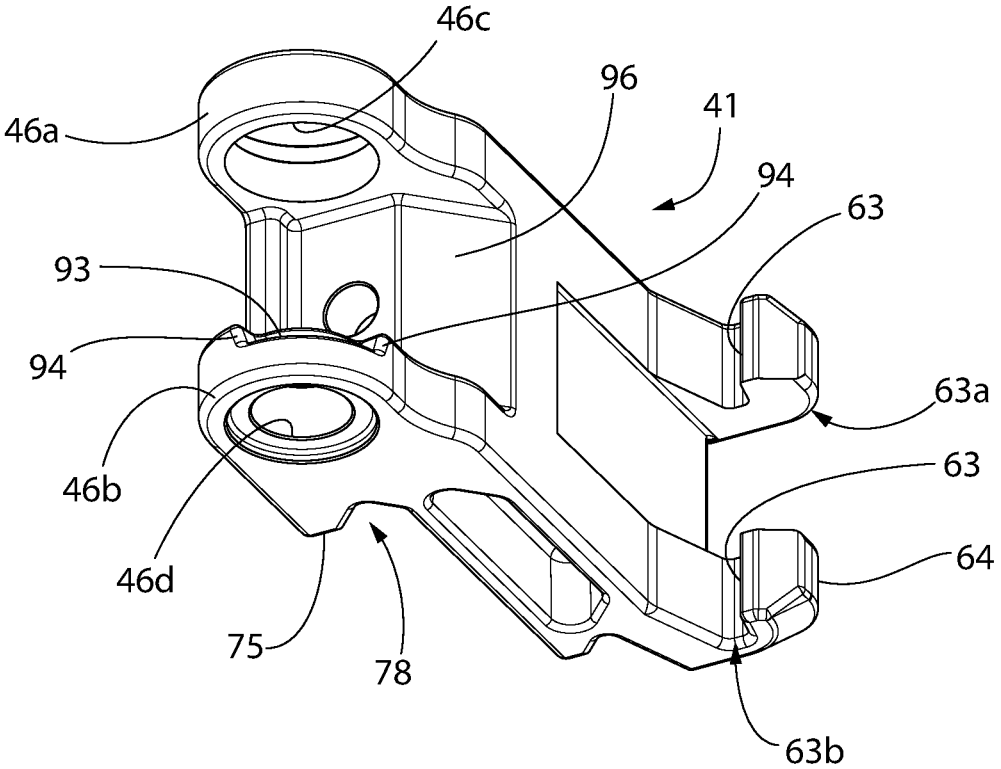
FIG. 39 is a bottom perspective view of the front hinge member of the hinge mechanism.
Figure 40:
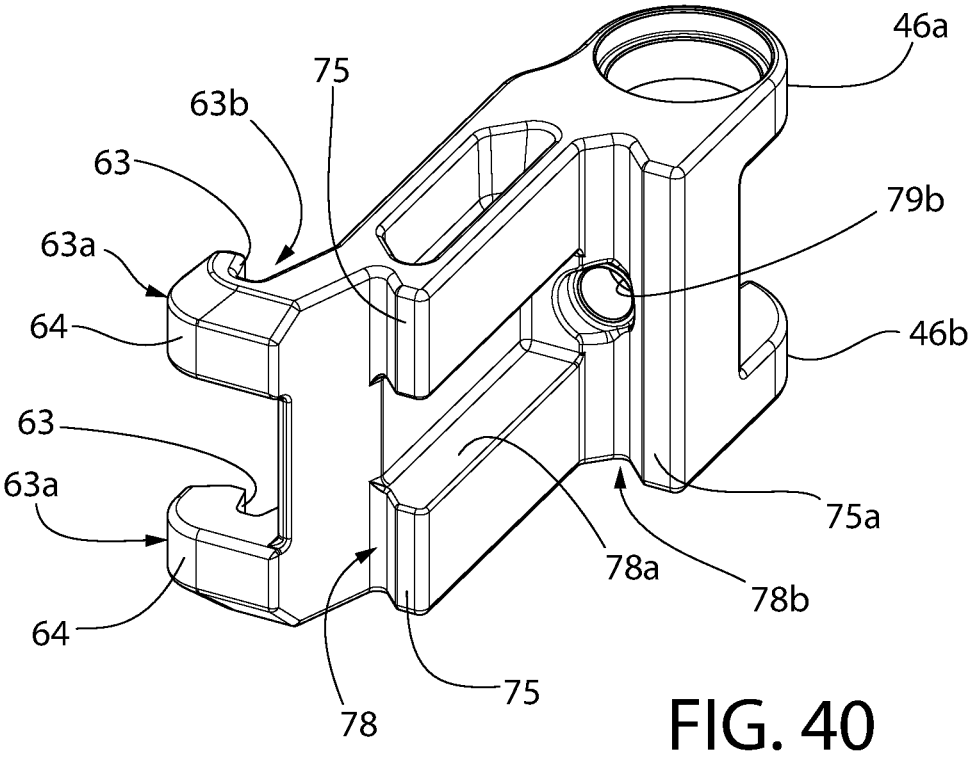
FIG. 40 is a top perspective view thereof.

In operation, the detent protrusion 91 is removably engaged with detent recess 93 when the stock 26 is folded forward (FIGS. 35-36). When the stock is arcuately rotated rearward inline with the firearm in the unfolded position, the detent protrusion 91 rides upward out of recess 93 as hinge barrel 44*a* rotates and enters a pocket 96 in front hinge member 41 thereby compressing detent spring 45. The protrusion 91 becomes removable seated on seating surface 95 within pocket 96 while the spring remains compressed. When the stock is rotated back to the folded position, the detent protrusion 91 is forced downwards by spring 45 to re-engaged detent recess 93. The dual pairs of mutually engaged tapered detent surfaces 92, 94 of the detent mechanism act to retain a stable folded position of the stock 26 to resist being jarred out of position better than a single pair.

Figure 45:
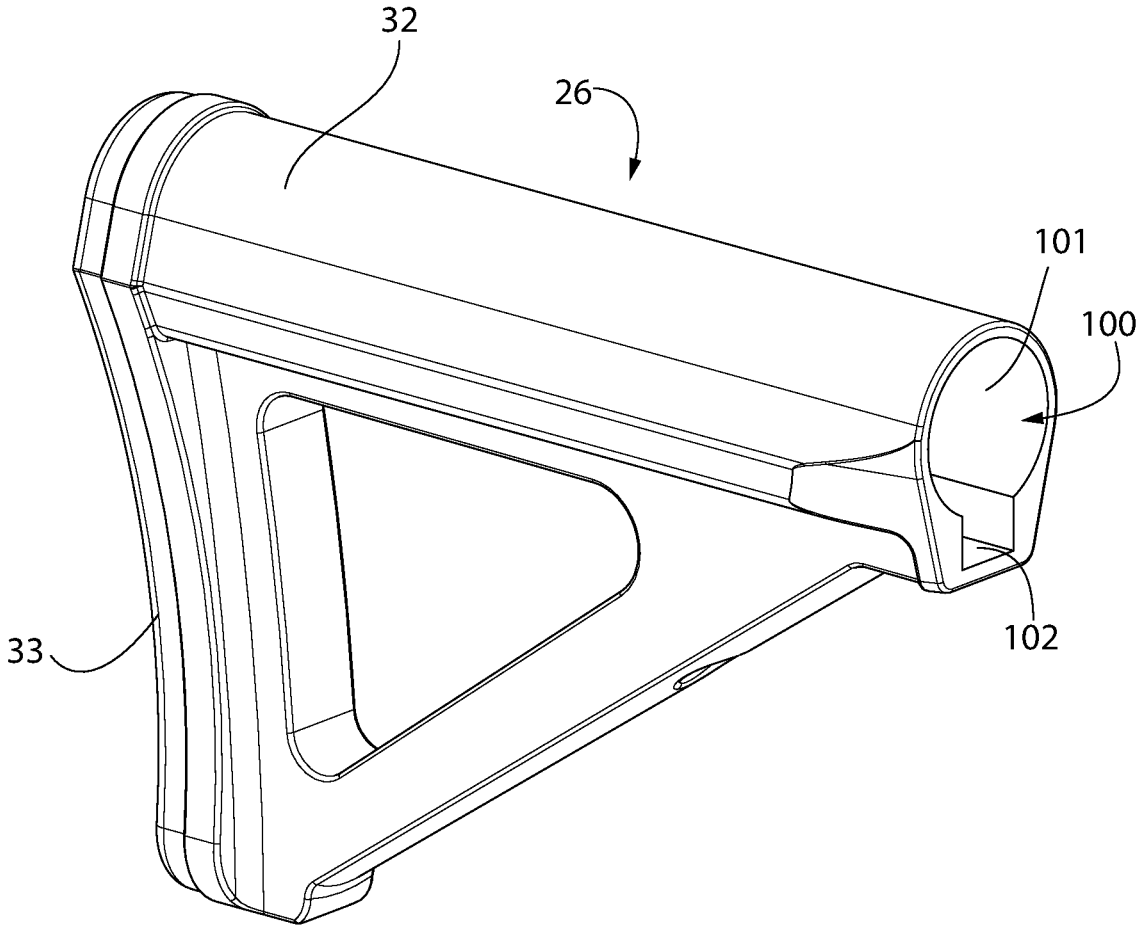
FIG. 45 is a perspective view of a first embodiment of a rear stock showing a common stock mounting interface of an AR-15 type stock.
Figure 46:
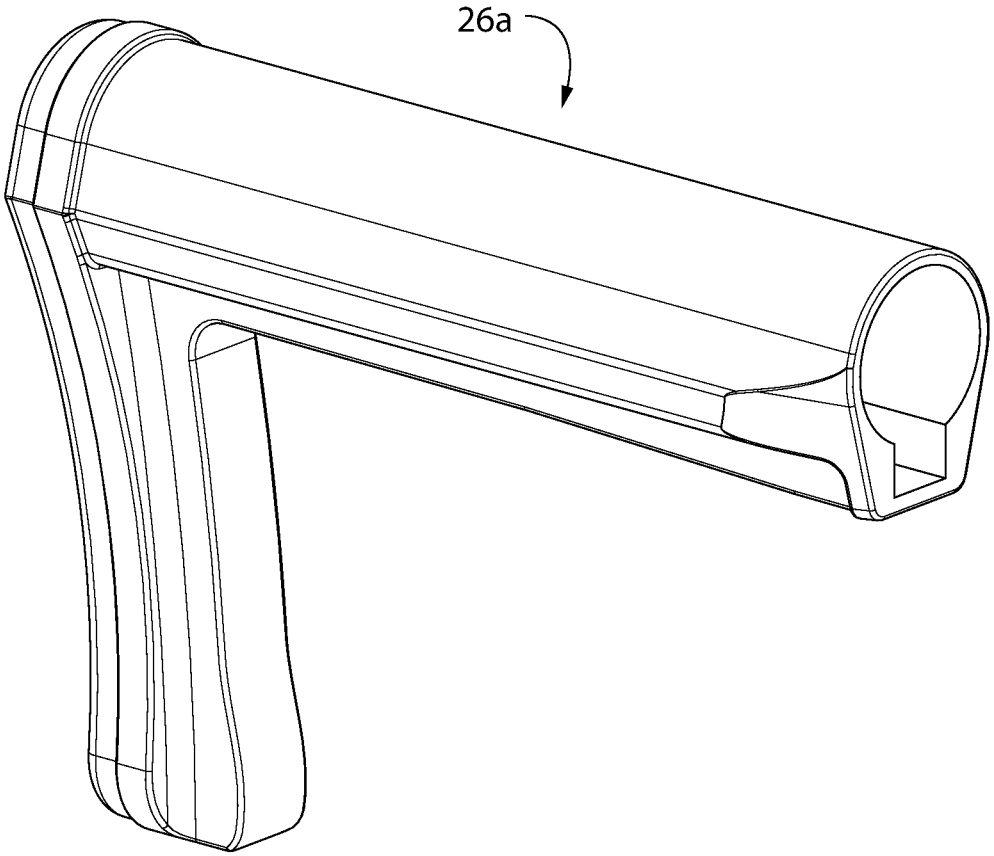
FIG. 46 is a perspective view of a second embodiment of a rear stock different than the first embodiment but having the same common stock mounting interface.
Figure 47:
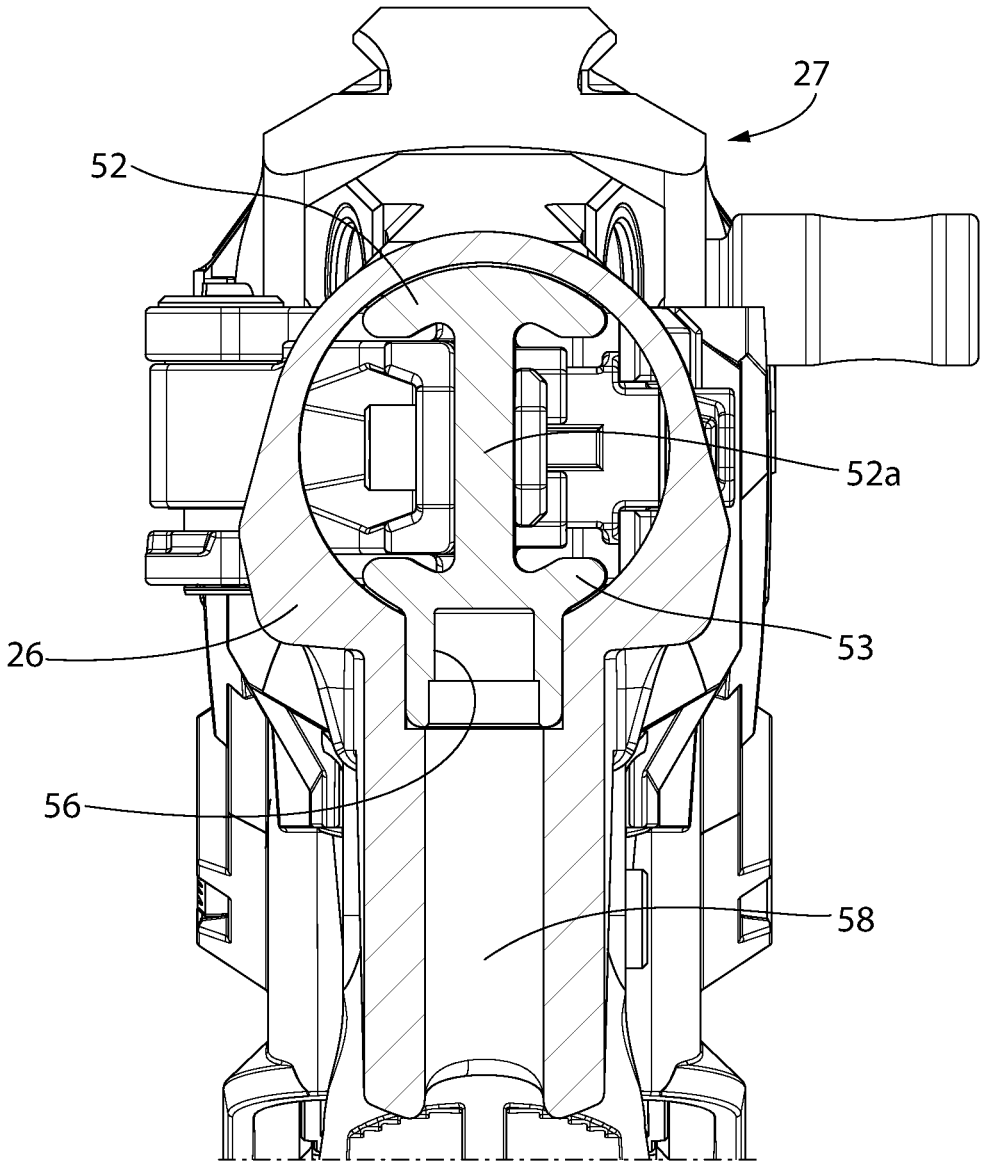
FIG. 47 is a transverse cross-sectional view through the rear stock of FIG. 45 or 46 mounted on a rear mounting extension coupled to the hinge mechanism.

The universal stock mounting interface of the stock coupling system will now be briefly described. The rearwardly and axially extending rear mounting extension 50 of the folding stock coupling system may be configured for mounting a plurality of different stocks 26 thereto having a common mounting configuration or profile. The mounting extension therefore advantageously provides a common mounting interface compatible with mounting the plurality of different rear stocks 26 thereto. This allows a user to select from among numerous stocks to suite personal preferences. The rear stocks may be AR-15 type stocks in one embodiment; representative examples of which are shown in the figure and particularly FIGS. 45-46 in isolation. The plurality of "different" stocks as used herein which share a common mounting profile are differentiated by at least one characteristic, such as without limitation configuration (including size and shape), material of construction, surface texture, or other features. For example, FIGS. 45 and 46 show two different stocks 26 and 26*a* which in this case have different configurations, but share a common mounting profile or interface for AR015 type stocks, as further described below.

Referring now to FIGS. 16-24 and 45-47 which show various aspects of the rear mounting extension 50 and stock 26, the stock has a generally tubular and forwardly open internal longitudinal passage 100 extending from the front to rear end of the stock. Mounting extension 50 is configured for slideable insertion into longitudinal mounting passageway of common cross-sectional configuration formed in each of the plurality of stocks.

In cross-sectional profile, passage 100 comprises a non-polygonal upper portion 101 and polygonal lower portion 102 contiguously open to the upper portion. Upper portion 101 may be circular and lower portion 102 may be rectilinear in cross-sectional profile in one embodiment as shown. This is a typical mounting configuration for AR-15 rifle type stocks which are normally mounted on non-folding buffer tubes in standard AR-15 rifles.

Rear mounting extension 50 has features which generally complement the cross-sectional profile of the plurality of stocks 26 to provide a relatively snug fit in the longitudinal passage 100 of the stocks. Rear mounting extension 50 has a longitudinally elongated rail-like body which may be considered somewhat I-beam shaped (see, e.g. FIGS. 17-19). Mounting extension 50 includes a longitudinally-extending vertical web 52*a*, arcuately curved upper flange 52 extending from lateral side at the top of the vertical web, and a longitudinally-extending lower rail portion 54 of generally rectilinear cross-sectional shape (e.g. square/rectangular). An intermediate portion of the extension therebetween comprises a pair of longitudinally-extending and laterally projecting lower flanges 53 at the bottom of vertical web 52*a*. Lower flanges 53 each may be obliquely angled upwards relative to that flat bottom surface of the lower rail portion 54 and upper flange 52. The upper and lower flanges are configured and arranged to slideably enter and engage the upper circular portion 101 of the stock longitudinal passage 110, whereas the lower rail portion 54 slideably engages the rectilinear lower portion 102 of passage 110 of the stocks.

Rear stock 26 is slideably adjustable in a plurality of indexed axial positions on rear mounting extension 50 to adjust the length of pull of the firearm to suit individual user preferences. To lock the stock in one of the selected axial positions, a plurality of longitudinally spaced apart indexed mounting holes 56 are formed in the bottom surface 55 of rear mounting extension 50 (see, e.g. FIGS. 12, 17, 38, and 47). Holes 56 may be formed in an axially elongated slot 57 in one non-limiting embodiment. In one embodiment, holes 56 are threaded and receive a stock mounting bolt 59 which is inserted through a cylindrical vertical passage 58 formed through a bottom portion of the rear stock 26. In other embodiments, holes 56 may be unthreaded to receive a spring-biased, lever-actuated stock mounting pin 59*a* which is provided on some AR-15 rifle stock designs.

In one embodiment, the features of the front hinge member 41, rear hinge member 42, and actuating button 60 previously described herein (e.g. locking protrusions, etc.) may be integrally formed as a unitary part of a monolithic body structure as shown in FIGS. 39-44. The hinge members may be formed of any suitable metallic material. The actuating button may be formed of a metallic material or suitably strong non-metallic material (e.g. plastic) in some embodiments. The rear extension rail 50 is preferably formed of metal for strength to support the stock. Metallic materials which may be used for the foregoing features may comprise without limitation aluminum, titanium, steel, or combinations thereof and other metals.

Figure 30:
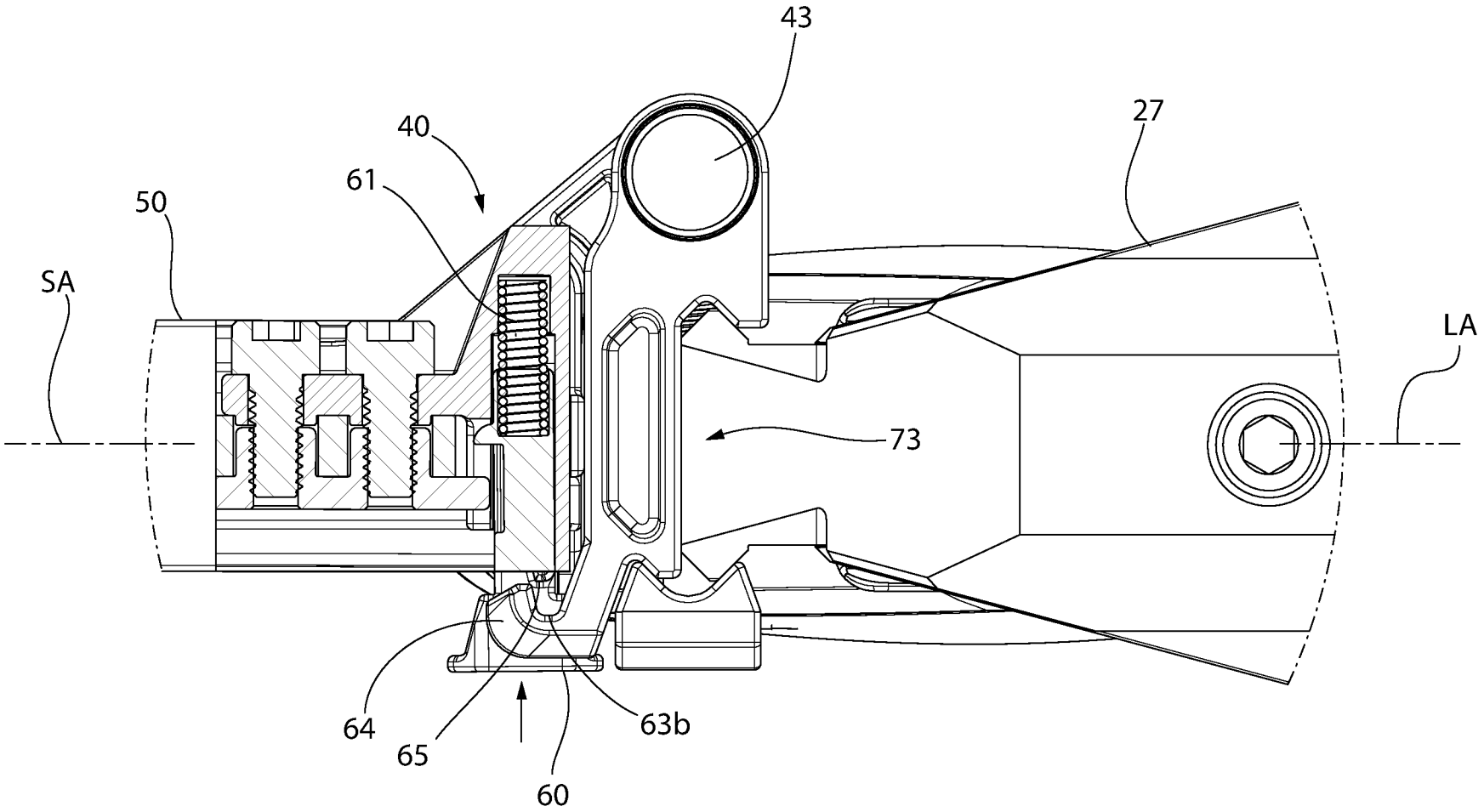
FIG. 30 is a second sequential transverse cross sectional view showing the hinge mechanism in a closed and locked condition.

A method or process for operating a folding rear stock 26 according to the present disclosure will now be briefly summarized. FIGS. 29-30 are sequential views showing the change of hinge mechanism 40 between the locked and unlocked conditions previously described herein. Reference is made to these and other figures noted below.

Figure 9:
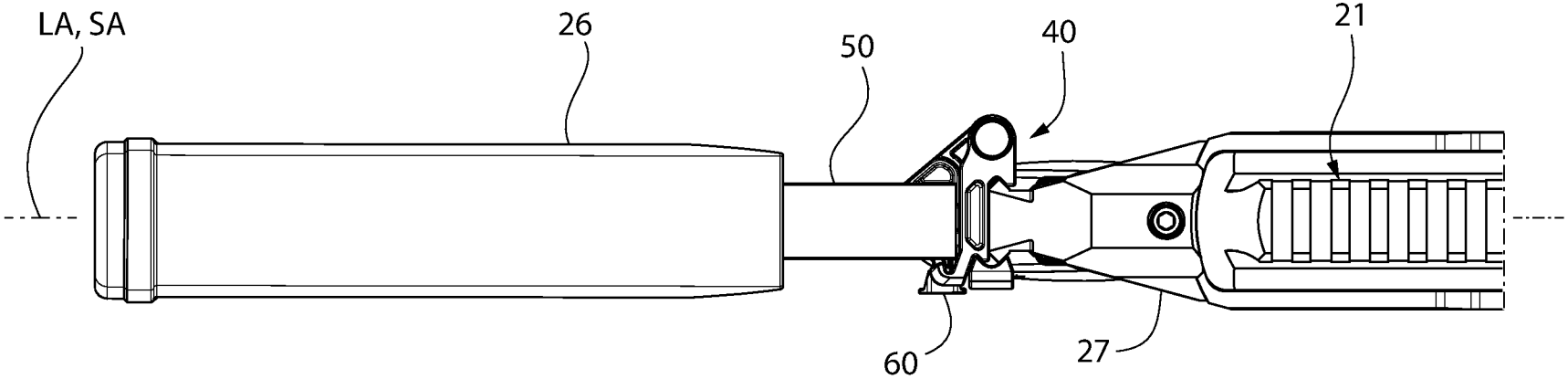
FIG. 9 is a partial rear top view thereof (showing the rear stock in an unfolded inline position)
Figure 10:
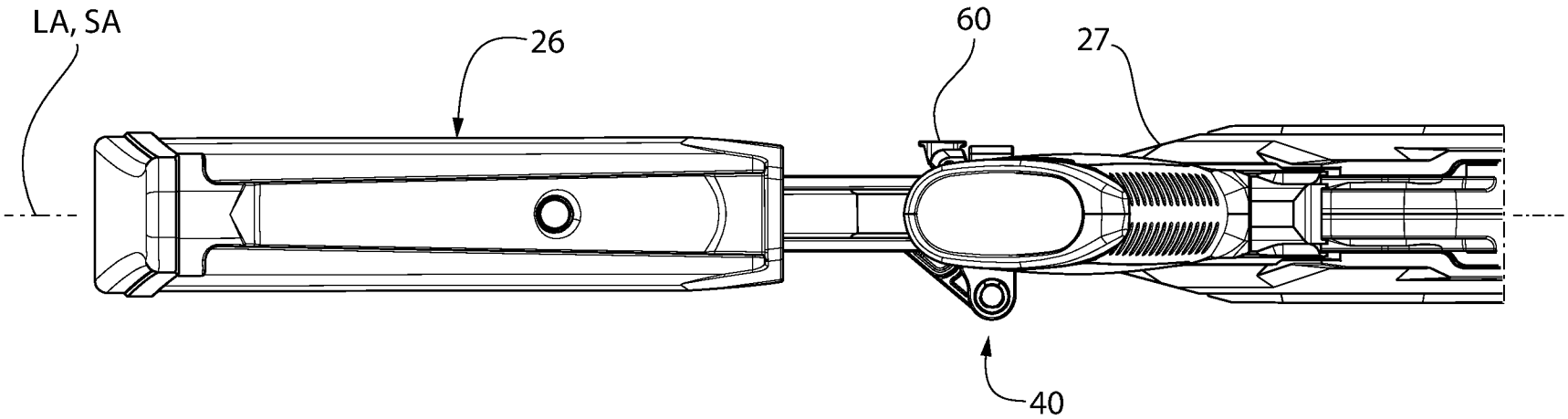
FIG. 10 is a partial rear bottom view thereof.
Figure 11:
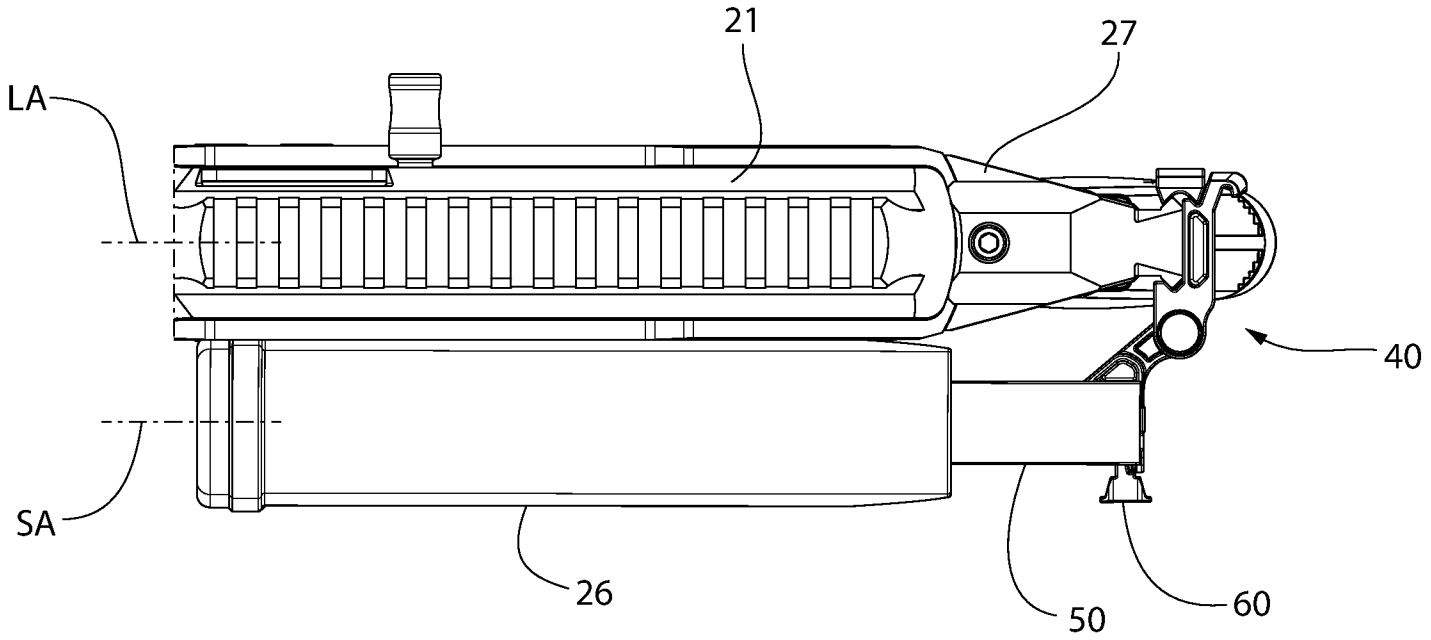
FIG. 11 is a partial top view thereof (showing the rear stock in a folded forward offset position)

To start the process, FIG. 29 shows the hinge mechanism 40 in the closed and locked condition with rear stock 26 locked into the unfolded position inline with a longitudinal axis of the firearm and ready for firing (see also FIGS. 1 and 9-10). Stock axis SA is inline and parallel to longitudinal axis LA of firearm 20. First locking protrusions 65 on actuating button 60 are engaged with locking slots 63*b* on second locking protrusions 64 of front hinge member 41. Tapered locking surfaces 62 and 63 are mutually engaged, which is maintained by the outward directed biasing force created by operating spring 61 on actuating button 60.

Next, the method continues with the user depressing the actuating button 60 of a hinge mechanism as shown in FIG. 30 (note inward directed pressing force arrow). Button 60 moves inwards into rear hinge member 42, thereby disengaging the pair of first locking protrusions 65 on the actuating button from the pair of corresponding second locking protrusions 64 and their locking recesses 63*b* on the front hinge member 41 to unlock the hinge mechanism.

Figure 31:
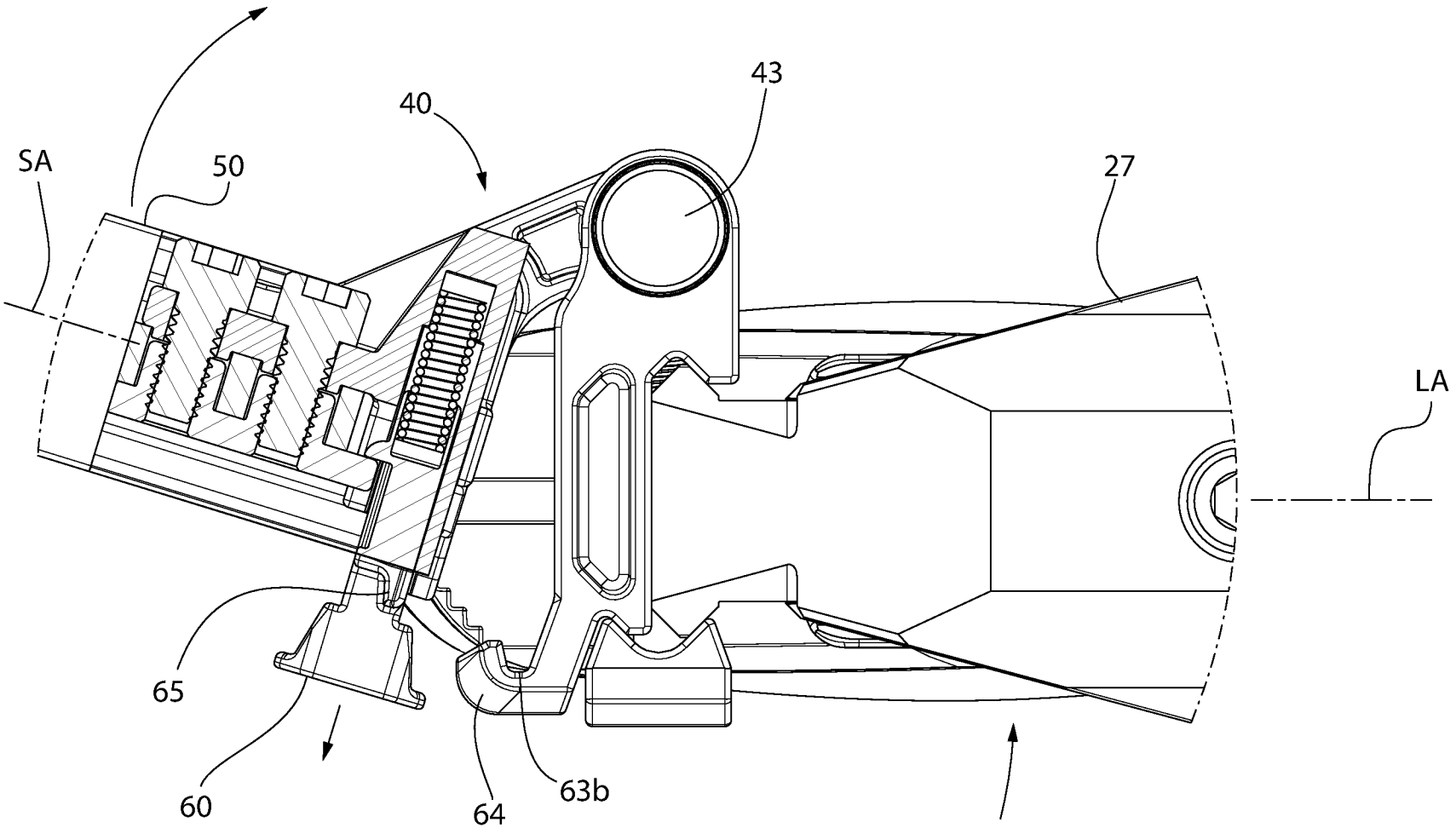
FIG. 31 is a third sequential transverse cross sectional view showing the hinge mechanism in an open and unlocked condition.
Figure 32:
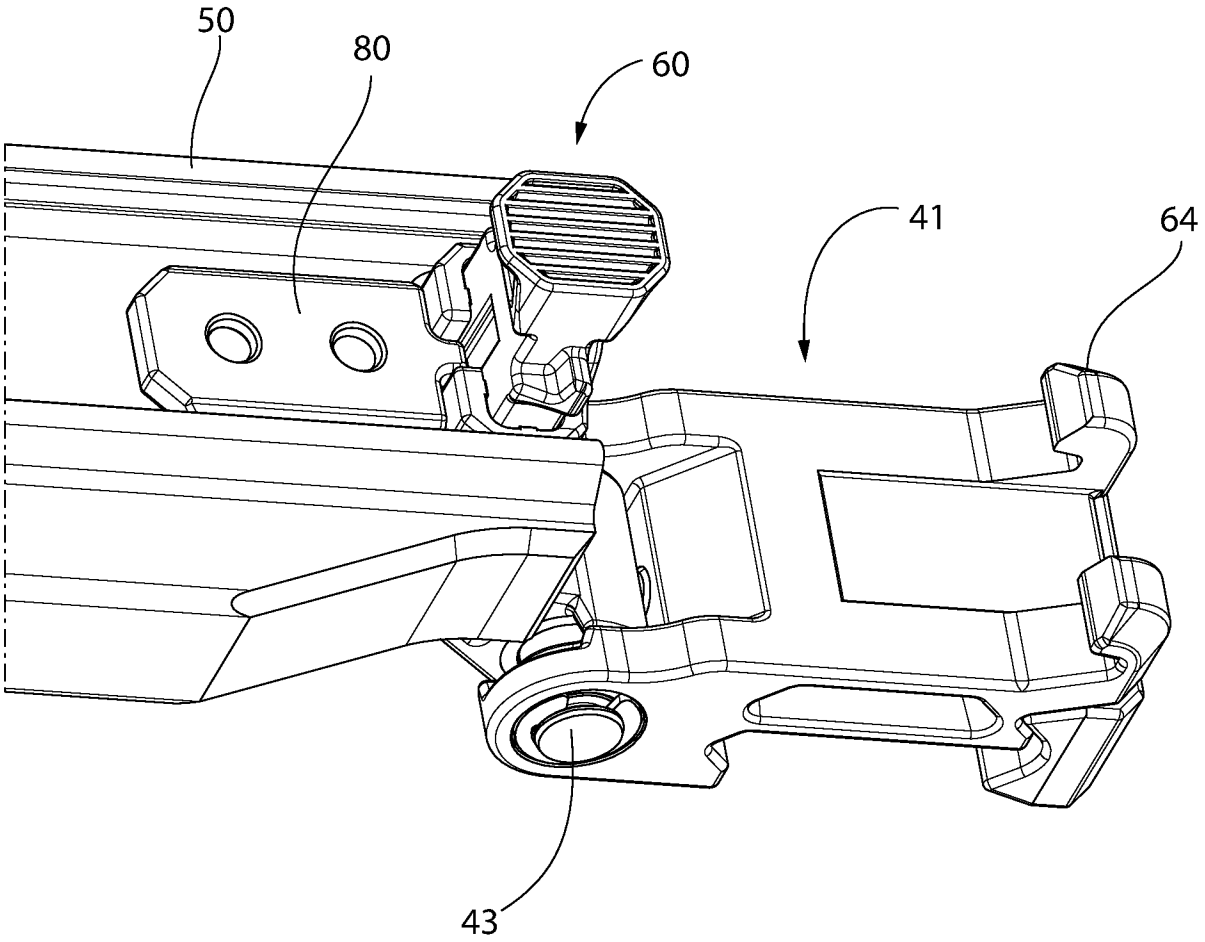
FIG. 32 is bottom perspective view of the hinge mechanism in the open and unlocked condition.
Figure 33:
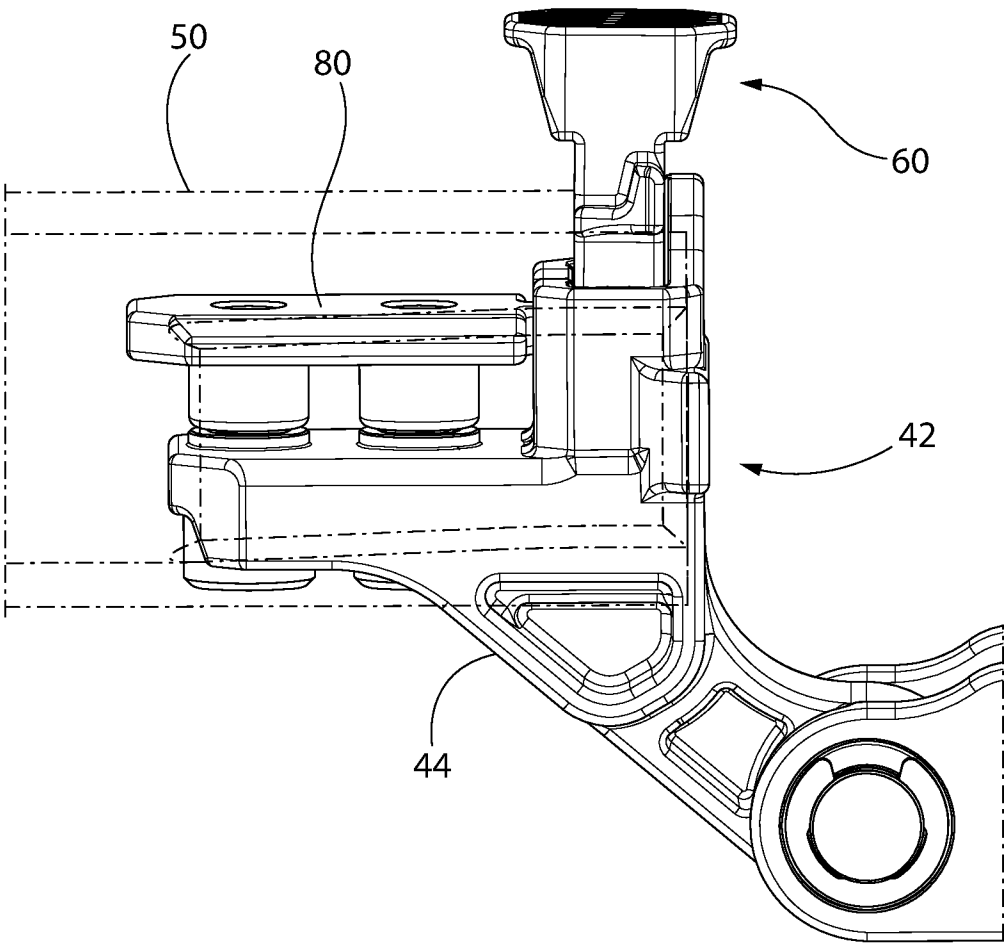
FIG. 33 is a top view of the rear hinge member of the hinge mechanism.
Figure 34:
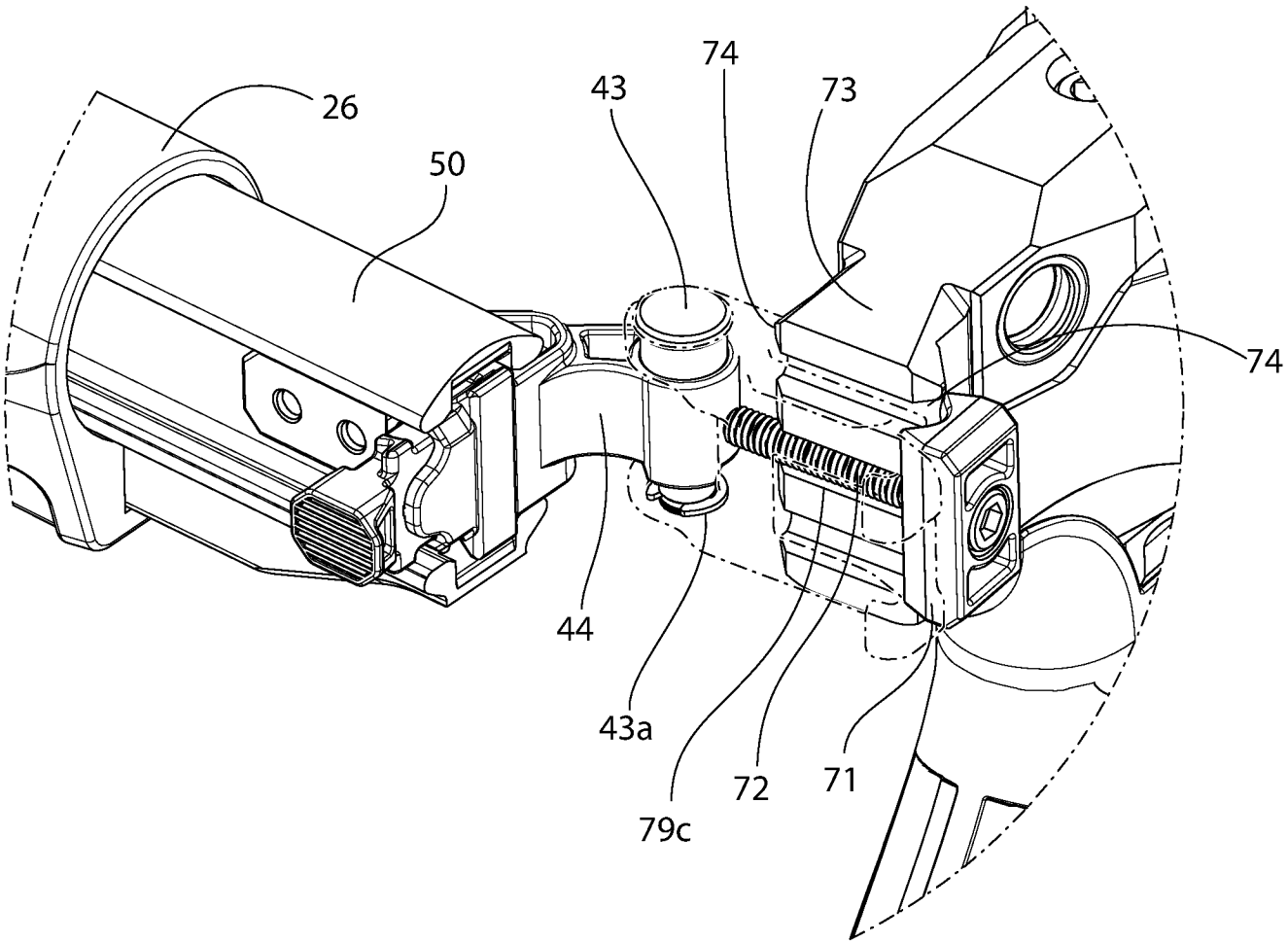
FIG. 34 is a perspective view showing the hinge mechanism in an open and unlocked position.

With the hinge member unlocked and the actuating button 60 remaining depressed, the rear stock 26 on rear mounting extension 50 may be now rotated by the user about the pivot axis defined by the hinge pin 43 of the hinge mechanism as shown in FIG. 31. Actuating button 60 may be releases and spring 61 returns the button to the outwards position shown. The rear stock is rotated forward until the hinge mechanism is fully opened and the rear stock is placed in the folded position alongside and adjacent main body 27 of the firearm (see, e.g. FIG. 11). Stock 26 may contact main body 27 in some embodiments. The stock is laterally offset from the longitudinal axis LA of the firearm. The stock axis SA is substantially parallel to longitudinal axis LA. The folded position of the rear stock and open position of hinge mechanism 40 is maintained by the detent mechanism 90 on the hinge barrels 44*a* and 46*b* of the rear and front hinge members 42, 41 respectively as previously described herein.

To return the rear stock 26 to the unfolded inline and ready-to-fire, the actuating button 60 advantageously need not be depressed (nor does any other type latching or lever mechanism need to be separately actuated). The user simply rotates the stock 26 rearward by hand which automatically disengages the detent mechanism 90. Arcuately curved actuating surfaces 63*a* formed on each locking protrusion 64 of front hinge member 41 engages locking protrusions 65 on actuating button 60 as the hinge is closed. This forces the actuating button inwards temporarily against the force of spring 61 as the locking protrusions 65 slide along the actuating surfaces 63*a*. When the locking recesses 63*b* become aligned with the locking protrusions 65 on the button, the button will snap back outwards to re-engage locking protrusions 65 with the locking recess to reestablish the fully closed and locked condition of the hinge mechanism 40. Stock 26 is again inline and ready-to-fire.

Variations of the foregoing method and order of steps are possible within the scope of the invention.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A stock coupling system for a firearm, the stock coupling system comprising:

a longitudinal axis;

a hinge mechanism comprising a front hinge member configured to be fixedly coupled to a main body of the firearm, and a rear hinge member pivotably coupled to front hinge member;

the hinge mechanism selectively movable between a locked condition in which the rear hinge member is not movable relative to the front hinge member, and an unlocked condition in which the rear hinge member is movable relative to the front hinge member;

an actuating button movably mounted to the hinge mechanism, the actuating button being configured to lock the rear hinge member to the front hinge member in the locked condition of the hinge mechanism;

an elongated rear mounting extension coupled to the rear hinge member, the rear mounting extension configured to detachably couple a rear stock thereto; and a retention plate fixedly coupling the rear mounting extension to the rear hinge member via a pair of fasteners passing through the rear hinge member and rear mounting extension to threadably engage the retention plate.

2. The system according to claim 1, wherein the actuating button is slideably mounted to the rear hinge member and manually depressible.

3. The system according to claim 2, wherein the actuating button is linearly movable between an outward position in which the actuating button is lockingly engaged with the front hinge member and an inward position disengaged from the front hinge member.

4. The system according to claim 3, further comprising an operating spring which biases the actuating button towards the outward position.

5. The system according to claim 3, wherein the actuating button comprises a pair of first tapered locking surfaces mutually engageable with a corresponding pair of second tapered locking surfaces of the front hinge member when the actuating button is in the outward position.

6. The system according to claim 5, wherein the first tapered surfaces are spaced apart on first locking protrusions formed on the actuating button and the second tapered surfaces are correspondingly spaced apart on hook-shaped second locking protrusions on the front hinge member to create a balanced locking force therebetween when the hinge mechanism is in the locked condition.

7. The system according to claim 6, wherein the second locking protrusions each define an inwardly open locking recess which receives and lockingly engages one of the first locking protrusions of the actuating button when the hinge mechanism is in the locked condition.

8. The system according to claim 7, wherein the actuating button further comprises an elongated body slideably received in a corresponding receptacle in the rear hinge member, and an enlarged actuating end at one end of the body protruding outwards from the rear hinge member configured to be pressed by a user.

9. The system according to claim 8, wherein the actuating end of actuating button is nested between the second locking protrusions of the front hinge member when the hinge mechanism is in the locked condition.

10. The system according to claim 1, wherein the retention plate further comprises a retention protrusion which engages a corresponding retention tab on the actuating button to prevent ejection of the actuating button by the operating spring.

11. The system according to claim 1, wherein the rear mounting extension is pivotable between an inline position in which a stock axis of the stock is inline with the longitudinal axis and an offset position in which the stock axis is laterally offset from the longitudinal axis.

12. The system according to claim 1, wherein a lower portion of the rear mounting extension includes a plurality of longitudinally spaced apart indexed mounting holes, the stock being mountable to the rear mounting extension via a fastener or pin engageable with a selected one of the mounting holes to allow a user to adjust a length of pull of the stocks.

13. The system according to claim 1, wherein the rear hinge member comprises an elongated hinge arm defining a tubular hinge barrel which is pivotably coupled to the front hinge member by a hinge pin.

14. The system according to claim 13, further comprising a detent mechanism comprising:

the hinge barrel including a detent protrusion defining a pair of tapered first detent surfaces selectively engageable with a corresponding pair of tapered detent surfaces formed in a detent recess of the front hinge member to retain the rear mounting extension in the offset position; and a spring which biases the detent protrusion into the detent recess.

15. The system according to claim 1, wherein the front hinge member comprises a tightenable clamp assembly configured for detachable coupling to a rail on the rear end of the main body of the firearm.

16. The system according to claim 1, wherein:

the rear mounting extension comprises a common mounting interface configured to be interchangeably coupled to a plurality of different rear stocks to the hinge mechanism; and the rear mounting extension being configured for slideable insertion into a forwardly open longitudinal passageway of common cross-sectional configuration formed in each of the plurality of stocks.

17. The system according to claim 16, wherein a first stock of the plurality of stocks has a first characteristic and a second stock of the plurality of stocks has a second characteristic different than the first characteristic.

18. A firearm with interchangeable stock coupling system comprising:

a main body comprising a longitudinal axis;

a hinge mechanism comprising a front hinge member fixedly coupled to the main body, and a rear hinge member pivotably coupled to front hinge member;

the hinge mechanism selectively movable between a locked condition in which the rear hinge member is not movable relative to the front hinge member, and an unlocked condition in which the rear hinge member is movable relative to the front hinge member;

an elongated rear mounting extension projecting rearward from the rear hinge member;

a first stock slideably coupled to the rear mounting extension, the stock slideable between a plurality of axial positions on the rear mounting extension for adjusting a length of pull of the firearm;

an actuating button movably mounted to the hinge mechanism, the actuating button being configured to lock the rear hinge member to the front hinge member in the locked condition of the hinge mechanism; and a retention plate fixedly coupling the rear mounting extension to the rear hinge member via a pair of fasteners passing through the rear hinge member and rear mounting extension to threadably engage the retention plate;

wherein the first stock is movable between an unfolded position in which the first stock is inline with the longitudinal axis when the hinge mechanism is in the locked condition, and a folded position in which the first stock is laterally offset from the longitudinal axis when the hinge mechanism is in the unlocked condition.

19. The firearm according to claim 18, wherein the actuating button is linearly movable between an outward position in which the actuating button is lockingly engaged with the front hinge member and an inward position disengaged from the front hinge member; and further comprising an operating spring which biases the actuating button towards the outward position.

20. The firearm according to claim 19, wherein the actuating button comprises a pair of first tapered locking surfaces mutually engageable with a corresponding pair of second tapered locking surfaces of the front hinge member when the actuating button is in the outward position.

21. The firearm according to claim 20, wherein the first tapered surfaces are spaced apart on first locking protrusions formed on the actuating button and the second tapered surfaces are correspondingly spaced apart on hook-shaped second locking protrusions on the front hinge member to create a balanced locking force therebetween when the hinge mechanism is in the locked condition.

22. The firearm according to claim 21, wherein the second locking protrusions each define an inwardly open locking recess which receives and lockingly engages one of the first locking protrusions of the actuating button when the hinge mechanism is in the locked condition.

23. The firearm according to claim 18, wherein the retention plate further comprises a retention protrusion which engages a corresponding retention tab on the actuating button to prevent ejection of the actuating button by the operating spring.

24. The firearm according to claim 18, wherein the rear mounting extension comprises a plurality of threaded bores, the first stock mounted to the rear mounting extension in a user-selected length of pull position by a threaded fastener rotatably coupled to one of the threaded bores.

25. The firearm according to claim 18, wherein:

the rear mounting extension comprises a common mounting interface configured to be interchangeably coupled to a plurality of different rear stocks to the hinge mechanism; and the rear mounting extension being configured for slideable insertion into a forwardly open longitudinal passageway of common cross-sectional configuration formed in each of the plurality of stocks.

26. The firearm according to claim 25, wherein a first stock of the plurality of stocks has a first characteristic and a second stock of the plurality of stocks has a second characteristic different than the first characteristic.

27. A method for operating a stock coupling system of a firearm, the method comprising:

providing a firearm having a rear stock locked in an unfolded position inline with a longitudinal axis of the firearm;

depressing an actuating button of a hinge mechanism having front and rear hinge members removably locked together;

disengaging a pair of first locking protrusions on the actuating button from a pair of corresponding second locking protrusions on the front hinge member to unlock the hinge mechanism;

rotating the rear stock about a pivot axis defined by the hinge mechanism; and placing the rear stock in a folded position laterally offset from the longitudinal axis of the firearm;

wherein the firearm comprises a retention plate fixedly coupling a rear mounting extension to the rear hinge member via a pair of fasteners passing through the rear hinge member and rear mounting extension to threadably engage the retention plate.

28. The method according to claim 27, wherein the disengaging step comprises removing the first locking protrusions from corresponding locking recesses formed by the second locking protrusions.

* * * * *